US010359193B2

(12) United States Patent
Kiyama et al.

(10) Patent No.: US 10,359,193 B2
(45) Date of Patent: Jul. 23, 2019

(54) COMBUSTION DEVICE

(71) Applicant: MITSUBISHI HITACHI POWER SYSTEMS, LTD., Kanagawa (JP)

(72) Inventors: Kenji Kiyama, Kanagawa (JP); Miki Shimogori, Kanagawa (JP); Toshihiko Mine, Kanagawa (JP); Satoshi Tadakuma, Kanagawa (JP); Kenichi Ochi, Kanagawa (JP); Koji Kuramashi, Kanagawa (JP); Yusuke Ochi, Kanagawa (JP); Akira Baba, Kanagawa (JP); Yuki Kondo, Kanagawa (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 336 days.

(21) Appl. No.: 14/902,961

(22) PCT Filed: Jul. 8, 2014

(86) PCT No.: PCT/JP2014/068201
§ 371 (c)(1),
(2) Date: Jan. 5, 2016

(87) PCT Pub. No.: WO2015/005350
PCT Pub. Date: Jan. 15, 2015

(65) Prior Publication Data

US 2016/0146463 A1 May 26, 2016

(30) Foreign Application Priority Data

Jul. 9, 2013 (JP) ..... 2013-143617

(51) Int. Cl.
*F23L 9/02* (2006.01)
*F23L 9/04* (2006.01)
(Continued)

(52) U.S. Cl.
CPC ..... *F23L 9/04* (2013.01); *F23C 5/28* (2013.01); *F23C 6/045* (2013.01); *F23L 9/02* (2013.01); *F23C 2201/101* (2013.01)

(58) Field of Classification Search
CPC ..... F23L 9/02; F23L 9/04; F23L 13/02; F23C 2201/101; F23C 6/05
See application file for complete search history.

(56) References Cited

U.S. PATENT DOCUMENTS 5,020,454 A * 6/1991 Hellewell ..... F23C 1/00 110/264
5,195,450 A * 3/1993 Marion ..... F23C 5/32 110/263
(Continued)

FOREIGN PATENT DOCUMENTS

JP 58-224205 12/1983
JP 9-112816 5/1997
(Continued)

OTHER PUBLICATIONS

International Search Report dated Oct. 14, 2014 in International (PCT) Application No. PCT/JP2014/068201.
(Continued)

*Primary Examiner* — David J Laux
(74) *Attorney, Agent, or Firm* — Wenderoth, Lind & Ponack, L.L.P.

(57) ABSTRACT

In accordance with the flow distribution of combustion gas including an unburned portion, an after-air port (AAP) arranged downstream of the two-stage combustion burner can effectively reduce the unburned portion by dividing as appropriate so as to avoid interaction, and by mixing together, two types of after-air having functions of linearity and spreading. As the configuration of this AAP, a primary nozzle for supplying primary after-air and having a vertical height greater than the horizontal width is provided in the
(Continued)

center in the opening of the AAP, a secondary nozzle for supplying secondary after-air is provided in the opening outside of the primary nozzle, and one or more secondary after-air guide vanes having a fixed or variable tilt angle relative to the after-air port center axis are provided at the outlet of the said secondary nozzle to deflect and supply the secondary after-air horizontally to the left or right.

15 Claims, 16 Drawing Sheets

(51) Int. Cl.
*F23C 6/04* (2006.01)
*F23C 5/28* (2006.01)

(56) References Cited

U.S. PATENT DOCUMENTS 5,315,939 A * 5/1994 Rini ..... F23C 5/32 110/232
5,343,820 A * 9/1994 Marion ..... F23C 5/32 110/264
5,899,172 A * 5/1999 Dallen ..... F23C 7/02 110/345
6,237,513 B1 * 5/2001 Tobiasz ..... F23C 5/32 110/347
7,047,891 B2 * 5/2006 Vatsky ..... F23L 9/04 110/210
8,505,472 B2 8/2013 Kamikawa et al.
2004/0221777 A1 * 11/2004 Hart ..... F23C 5/32 110/213
2005/0058958 A1 * 3/2005 Kobayashi ..... F23C 5/32 431/10
2009/0087805 A1 4/2009 Ochi et al.
2009/0183660 A1 * 7/2009 Wessel ..... F22B 35/007 110/188
2010/0224108 A1 9/2010 Kamikawa et al.
2012/0174837 A1 * 7/2012 Shan ..... F23C 6/045 110/347
2013/0255547 A1 10/2013 Kamikawa et al.

FOREIGN PATENT DOCUMENTS

JP 9-112878 5/1997
JP 2001-182922 7/2001
JP 2001-355832 12/2001
JP 2005-134102 5/2005
JP 2007-192452 8/2007
WO 2007/105335 9/2007

OTHER PUBLICATIONS

International Preliminary Report on Patentability and Written Opinion of the International Searching Authority dated Jan. 21, 2016 in International (PCT) Application No. PCT/JP2014/068201.

* cited by examiner (a)

(b)

(a)

COMBUSTION DEVICE

TECHNICAL FIELD

The present invention relates to an after-air port and a combustion device such as a boiler including the after-air ports, and particularly, relates to an after-air port which is capable of low nitrogen oxide (low NOx) combustion having high combustion efficiency.

BACKGROUND ART

In a furnace using a so-called two-stage combustion in which a fuel is burned by burners under a condition of air deficiency, and the remaining air required for complete combustion is supplied from after-air ports, a flow rate distribution of combustion gas containing unburned components rising to an after-air port region varies according to an arrangement of the burners and a method of supplying the fuel and air from the burners. To suppress the unburned components such as unburned carbon or CO remaining in the furnace outlet, it is important to appropriately supply the two-stage combustion air depending on the flow rate distribution of the combustion gas rising to the after-air port region.

FIG. 14 is a view illustrating an example of an arrangement of burners 6, after-air ports 7*a*, sub after-air ports 7*b* and shapes of jets in the furnace in the related art. FIG. 14(*a*) is a front view illustrating a furnace wall in which the burners 6, the after-air ports 7*a* and the sub after-air ports 7*b* are disposed, FIG. 14(*b*) is a view (side sectional view) illustrating shapes of jets consisting of fuel and air injected from the burners 6, the after-air ports 7*a* and the sub after-air ports 7*b* as viewed from a side surface of the furnace, and FIG. 14(*c*) is a plan sectional view of the furnace illustrating the shapes of after-air jets as viewed from the top, which is a view taken in an arrow direction of line B-B in FIG. 14(*b*).

In the furnace illustrated in FIG. 14, the burners 6 are disposed to the both opposed faces in four rows and three stages, the after-air ports 7*a* are installed above the burners 6, and the sub after-air ports 7*b* are installed nearer furnace side walls at a slightly lower height than the height of the after-air ports 7*a*. The fuel and air injected from the burners 6, the after-air ports 7*a* and the sub after-air ports 7*b* which are installed on opposed furnace front and rear walls collide at the central part of the furnace in a depth direction (anteroposterior direction) thereof, as illustrated in FIGS. 14(*b*) and 14(*c*), and after colliding, mainly flow toward an upper side, as illustrated in FIG. 14(*b*). As a result of the above-described flow pattern in the furnace, the flow rate distribution of the rising gas at a central part in the furnace depth direction just below the after-air port region on an A-A line cross-section of FIG. 14(*b*) becomes a form illustrated by a solid line in FIG. 15(*a*), and the flow rate distribution of the rising gas at the central part in the furnace width direction on the same A-A line cross-section becomes a form illustrated by the solid line in FIG. 15(*b*).

The jets of the fuel and air from the burners 6 disposed on the opposed front and rear walls as illustrated in FIG. 14(*a*) collide at the central part in the furnace depth direction to change the direction thereof, but the flow toward the upper side which is the gas outlet side of the furnace becomes greatest, such that, as illustrated by the solid line in FIG. 15(*a*), the flow rate is highest just above the burner row, while the flow rate is lower between the burner rows and between the wing burner rows and the side walls. As a result of the flow in the furnace, in the flow rate distribution as viewed from the central part in the furnace width direction from the side wall side (FIG. 15(*b*)), it becomes a distribution that the flow rate is highest at the central part in the furnace depth direction, while the flow rate is lower in the vicinity of the front and rear walls of the furnace.

If the above-described flow rate distribution of the rising gas in the furnace is broadly classified, it may be divided into a region A (a portion surrounded by a dotted line frame in FIGS. 15(*a*) and 15(*b*)) having relatively high flow rates in the vicinity of the central part of the furnace depth and width directions, regions C (portions surrounded by a one-dot dash line frame in FIG. 15(*b*)) having relatively low flow rates at the front and rear walls, and regions B (portions surrounded by a two-dot dash line frame in FIG. 15(*a*)) having relatively low flow rates in the vicinity of the side walls. In order to minimize the unburned components remaining at the furnace outlet, it is important that after-air having an appropriate flow rate and appropriate momentum is supplied to all the regions A, B and C from the after-air ports 7*a* and 7*b*, to facilitate the mixing in an appropriate ratio of the unburned components and the air at the respective regions A, B and C.

Patent Literature 1 (Japanese Unexamined Patent Application Publication No. 2007-192452) discloses a boiler device which is characterized in that, in a combustion device for a solid fuel such as coal, a direction of after-air blowing out into a furnace from after-air ports is horizontally divided into three or more directions; and an air dividing member is provided therein, so that the respective divided directions of air do not become the same direction as each other.

Patent Literature 2 (Japanese Patent No. 5028278) discloses an invention of a pulverized coal-fired boiler including: a furnace which forms the pulverized coal-fired boiler; a plurality of burners disposed on an upstream side of a furnace wall surface to supply pulverized coal of fuel and air into the furnace and to burn the same; and a plurality of after-air ports disposed on the furnace wall surface which is to be an upper side from a position in which the burners are installed to supply the air, wherein the after-air ports consist of main after-air ports supplying a large amount of air and sub after-air ports supplying a small amount of air.

The invention described in Patent Literature 2 is the pulverized coal-fired boiler in which: the sub after-air ports are disposed on the furnace wall surfaces which is to be a downstream side of the main after-air ports and at a position of the furnace wall surface just above the main after-air ports, or disposed on the furnace wall surfaces which is to be the upstream side of the main after-air ports and at a position of the furnace wall surface just below the main after-air ports; a sectional center of each of the sub after-air ports is within a range of 1 time or more to 5 times or less of a diameter of the main after-air ports from a sectional center of the main after-air ports, one main after-air port and one sub after-air port are set to be one pair, and at least one pair is connected to the same wind box; and a plurality of the wind boxes are installed by arranging on the furnace wall surface in one direction.

Patent Literature 3 (Japanese Unexamined Patent Application Publication No. S58-224205) discloses a combustion device having OA ports configured to perform two-stage combustion or denitration combustion in the furnace, wherein the combustion device includes: a combustion method, in which small sub OA ports are disposed nearer the side walls than the row of wing burners to improve the supply of the air to the vicinity of the side walls, so as to more sufficiently exert the function of the OA ports performing a complete combustion; and a method for reducing unburned components at a furnace outlet which is capable of controlling a direction of an airflow by mean of swirl generation of the OA ports.

It is effective to adopt a configuration including the auxiliary OA ports of Patent Literature 3 as a means for appropriately supplying two-stage combustion air in the vicinity of the side walls of the regions B illustrated by the two-dot dash line frame in FIG. 15.

As a method of supplying air to the regions B in the vicinity of the side walls of the furnace, it may be supplied from openings installed in front and rear walls in the vicinity of the side walls as the invention described in Patent Literature 3, and it may be supplied from one or more openings installed in the side walls. In addition, there is a case in which the air flow rate supplied from the burners and after-air ports near the side walls is higher than the air flow rate supplied from the burners and the after-air ports positioned at the central side in chamber width (furnace full width) direction, such that the air flow nearer the side walls is increased, and thereby a similar effect of reducing the unburned components is obtained.

Patent Literature 4 (Japanese Unexamined Patent Application Publication No. 2001-355832) discloses a configuration including: a cylindrical sleeve which is provided to divide an air flow passage in an air port; and a baffle which is attached to a tip of the sleeve at the exit of the sleeve so as to spread the flow in the air flow passage to the outside from a center axis of the air port, wherein a spreading part of the sleeve and the baffle have the same inclination angle as each other. This is an invention in which, due to the above-described configuration, it is possible to spread the airflow by the inclination angle of the spreading part of the sleeve and the tip of the baffle without a swirl generating device, and increase a mixing rate with a combustion gas from the burner on the upstream side of the air ports.

Patent Literature 5 (US Patent Publication No. 2012/174837) describes a configuration which is capable of changing a direction of the flow of after-air within a furnace by providing vanes which can change a flow direction of the air at an outlet in an air port.

Patent Literature 6 (Japanese Patent Publication No. 2717959) discloses a multi-directional control device for an after-air hole of a type which has an after-air hole configured to send secondary air from an opening of a wind box to an opening of a furnace, and a longitudinal conduit for defining a chamber, wherein the secondary air from the wind box passes through the chamber toward the furnace. In addition, the multi-directional control device disclosed in the above document includes a plurality of first louvers which are rotatably mounted inside of the chamber with respect to the conduit based on a first axis orthogonal to a longitudinal axis of the conduit, a plurality of second louvers which are rotatably mounted inside of the chamber with respect to the conduit based on a second axis orthogonal to the longitudinal axis of the conduit and orthogonal to the first louver, and a means configured to control an air flow direction passing through the opening of the furnace by rotating each of the first louver and the second louver.

CITATION LIST

Patent Literature

[Patent Literature 1] Japanese Unexamined Patent Application Publication No. 2007-192452

[Patent Literature 2] Japanese Patent Publication No. 5028278

[Patent Literature 3] Japanese Unexamined Patent Application Publication No. S58-224205

[Patent Literature 4] Japanese Unexamined Patent Application Publication No. 2001-355832

[Patent Literature 5] U.S. Patent Publication No. 2012/174837

[Patent Literature 6] Japanese Patent Publication No. 2717959

SUMMARY OF INVENTION

Technical Problem

In the invention described in Patent Literature 1, the flow pathway in the after-air port is divided into after-air main flow and after-air sub flow by using a simple dividing member (plate), thereby enabling control of the spreadability and direction of the after-air in a horizontal direction.

However, since the jet itself spreads within each divided air flow pathway before injecting, and becomes an integrated flow in a region leaving the after-air port, as described in specification paragraph [0062] of Patent Literature 1, there is an interaction between the main flow and the sub flow of after-air, which constrains the mutual flow therethrough. Patent Literature 1 defines the flow rate distribution of the main flow and the sub flow in order to suppress the interaction, but it does not fundamentally eliminate the interaction. That is, if relatively increasing the flow rate or flow velocity of the after-air main flow in order to provide penetration in the after-air, the after-air sub flow is drawn into the after-air main flow to decrease the spreadability, and passing through of the unburned gas in the vicinity of the front and rear walls of the furnace is increased. Reversely, if relatively increasing the flow rate or flow velocity of the after-air sub flow in order to provide the spreadability in the after-air, the after-air main flow is drawn into the after-air sub flow to decrease the penetration, and passing through of the unburned gas in the central part of the furnace is increased. In essence, the integrated jet having both of the penetration and the spreadability is affected by a rising gas flow from the burner side as described below, such that it has a characteristic that it may be easily curved upward, and thereby it is not suitable for the main flow of the two-stage combustion air in which penetration is important.

Inherently, the invention described in Patent Literature 1 is an invention characterized by supplying to slightly spread the after-air jet in the horizontal direction, but a spreading inclination angle of the after-air jet has an upper limit value, and there is no consideration for the after-air supply to a wide area of the regions C illustrated by the one-dot dash line frame in FIG. 15(*b*).

In the invention described in Patent Literature 2, two types of circular after-air ports of the main after-air port supplying a large amount of air and the sub after-air port supplying a small amount of air are installed. Therefore, there are problems that have not yet been solved as described below.

(a) The outlet of the main after-air port has a circular cross-section shape, and as described below, it has a characteristic that it may be easily curved upward due to the rising gas flow from the burner side, and there is room for improvement of the main flow of the two-stage combustion air in which the penetration is important.

(b) Due to the configuration in which multiple stages of two types of the main after-air port and the sub after-air port are installed, costs are higher than the configuration of one stage of one type of the after-air port.

(c) A gas residence time in the furnace from an after-air port positioned at an upper stage among the multiple stages of after-air ports to the furnace outlet is smaller than the gas residence time in the furnace from an after-air port positioned at a lower stage to the furnace outlet, such that the residence time required for combusting the unburned components may not be secured. Otherwise, when securing the residence time required in the invention described in Patent Literature 2, it is necessary to increase a height of the furnace, which may cause an increase in costs.

The invention described in Patent Literature 3 has the configuration in which the small auxiliary OA ports are disposed nearer the furnace side walls than the burner row of the end part in the front and rear walls of the furnace in addition to the major OA ports for performing the complete combustion, to improve the supply of the air in the vicinity of the side walls, which is effective for reducing the unburned components in the regions B of FIG. 15(*a*), but which cannot contribute to reducing the unburned components in the vicinity of the front and rear walls of the furnace in the regions C of FIG. 15(*b*).

Patent Literature 4 has the configuration of spreading the air flow passage within the air port disposed on the downstream side of the conventional burners, which are capable of applying the spreadability in the air jet supplied into the furnace. However, this configuration may not obtain an effect of reducing the unburned components of the combustion gas by actively increasing the air flow nearer the front and rear walls of the furnace.

The invention described in Patent Literature 5 has the configuration which is only capable of appropriately changing the flow direction of the air in the outlet within the air port, and is adapted to supplement the function of a conventional after-air nozzle, but it is not considered to compensate the lack of the after-air flow nearer the furnace walls.

The invention described in Patent Literature 6 has problems as described below.

(1) The flow of the after-air may be deflected in a vertical direction or horizontal direction, but it is not suitable for forming a flow in which the horizontal direction and the vertical direction are combined.

(2) It is difficult to obtain jets forming the spreadability in both directions of the horizontal direction and the vertical direction, and it is not suitable for supplying the after-air in both directions of the regions C illustrated in FIG. 3(*b*) and the regions A illustrated in FIGS. 3(*a*) and (*b*).

It is the object of the present invention to provide an after-air port which is capable of eliminating the above-described problems relating to the after-air supplying method, and effectively reducing unburned components by appropriately separating two types of after-air having functions of penetration and spreadability without mutual interaction, and by supplying and mixing after-air effectively depending on a flow rate distribution of the combustion gas containing the unburned components, and thus to achieve more improved combustion performance.

Solution to Problem

The above-described object is achieved by the following means for solving the problems.

An invention according to a first aspect of the present invention is a combustion device in which burners are disposed on a furnace wall to burn fuel with an amount of air of theoretical air or less, and after-air ports to supply air are disposed on the furnace wall in the downstream side from the position where the burners are disposed, the combustion device including: a primary after-air nozzle (5) which is provided at the central part in an opening (17) of the after-air port with larger vertical height than horizontal width to supply the primary after-air (1); secondary after-air nozzles (14) which are provided in the opening (17) of the after-air port at the outside of the primary after-air nozzle (5) to supply the secondary after-air (11); and one or more pairs of secondary after-air guide vanes (15) which are provided in the outlet parts of the secondary after-air nozzles (14) and have inclination angles with respect to the central axis ($C_0$) of the after-air port, so as to deflect the secondary after-air (11) right and left in the horizontal direction and supply the same.

An invention of a second aspect of the present invention is the combustion device according to the first aspect of the present invention, wherein the primary after-air nozzle (5) includes one or more primary after-air guide vanes (8) which are provided in the outlet part thereof and are configured to control an inclination angle thereof in the horizontal direction or upward from the horizontal direction, so as to supply the primary after-air (1) upward with an inclination angle.

An invention of a third aspect of the present invention is the combustion device according to the first aspect of the present invention, wherein the secondary after-air guide vanes (15) all have the same inclination angles with respect to the central axis ($C_0$) of the after-air port.

An invention of a fourth aspect of the present invention is the combustion device according to the first aspect of the present invention, wherein each of the secondary after-air guide vanes (15) has a deviation in the inclination angles thereof with respect to the central axis ($C_0$) of the after-air port.

An invention of a fifth aspect of the present invention is the combustion device according to the fourth aspect of the present invention, wherein the secondary after-air guide vanes (15) have inclination angles becoming larger with increasing distance away from the primary after-air nozzle (5) with respect to the central axis ($C_0$) of the after-air port.

An invention of a sixth aspect of the present invention is the combustion device according to any one of the first to fifth aspects of the present invention, wherein the secondary after-air guide vanes (15) are configured to change the inclination angles thereof.

An invention of a seventh aspect of the present invention is the combustion device according to any one of the first to sixth aspects of the present invention, wherein the secondary after-air guide vanes (15) are configured to move in the anteroposterior direction of the furnace wall.

An invention of an eighth aspect of the present invention is the combustion device according to any one of the first to seventh aspects of the present invention, wherein a first guide member (16) is provided at a portion nearest the primary after-air nozzle (5), to supply a small amount of secondary after-air (11) along a surface of the secondary after-air guide vane (15) on the furnace side thereof and the outer surface of the tip part of the primary after-air nozzle (5).

An invention of a ninth aspect of the present invention is the combustion device according to any one of the first to eighth aspects of the present invention, wherein the openings (17) of the after-air port have spreading parts (18) of a shape whose end spreads toward the furnace, and are respectively provided with second guide members (19) to supply a small amount of the secondary after-air (11) along surfaces of the spreading parts (18).

An invention of a tenth aspect of the present invention is the combustion device according to any one of the first to ninth aspects of the present invention, wherein any one or both of an inlet part of the primary after-air nozzle (5) and inlet parts of the secondary after-air nozzles (14) are provided with air flow rate control functional members (3 and 12) to change a flow path resistance.

An invention of an eleventh aspect of the present invention is the combustion device according to any one of the first to tenth aspects of the present invention, wherein the primary after-air nozzle (5) includes a contracting member (5*a*) having a flow passage cross-sectional area gradually decreased in a flow direction of air, which is attached to the inlet part thereof.

An invention of a twelfth aspect of the present invention is the combustion device according to any one of the first to eleventh aspects of the present invention, wherein the primary after-air nozzle (5) includes a contracting member (5*b*) having a horizontal width gradually decreased in a flow direction of air, which is attached to the tip part thereof.

An invention of a thirteenth aspect of the present invention is the combustion device according to any one of the first to twelfth aspects of the present invention, wherein any one or both of the primary after-air nozzle (5) and the secondary after-air nozzles (14) include rectifiers (4 and/or 13) installed in flow passages thereof.

An invention of a fourteenth aspect of the present invention is the combustion device according to any one of the first to thirteenth aspects of the present invention, wherein the opening (17) of the after-air port is formed in a rectangular shape.

An invention of a fifteenth aspect of the present invention is the combustion device according to any one of the first to thirteenth aspects of the present invention, wherein the opening (17) of the after-air port is formed in a polygonal shape.

Advantageous Effects of Invention

According to the present invention, there is provided an after-air port which is capable of effectively reducing the unburned components by appropriately separating two types of after-air having functions of penetration and spreadability without mutual interaction, and by supplying and mixing after-air effectively depending on the flow rate distribution of combustion gas containing the unburned components, and by controlling the after-air having penetration so as to be deflected upward, it is possible to achieve improved combustion performance.

That is, in accordance with the invention of the first aspect of the present invention, the jets of the primary after-air (1) and the secondary after-air (11) are reliably separated in the furnace, and the primary after-air (1) has a strong penetration and reliably reaches a region A (FIG. 15) of the central part in the furnace in which a gas rising in the furnace has a high flow rate to promote the combustion of the unburned components in the region A part, and the secondary after-air (11) has the spreadability and is supplied to a region C (FIG. 15) in the vicinity of front and rear walls of the furnace in which the gas rising in the furnace has a low flow rate to promote the combustion of the unburned components in the region C part, such that it is possible to appropriately supply the after-air throughout the entirety of the furnace by both of the primary after-air (1) and the secondary after-air (11), and minimize the unburned components remaining at the outlet part of the furnace.

In accordance with the second aspect of the present invention, in addition to the effects of the invention according to the first aspect of the present invention, the primary after-air guide vanes (8) are configured to vary the inclination angle thereof, such that it is possible to control the primary after-air (1) so as to direct to the horizontal direction or upward direction inside the furnace.

In accordance with the third aspect of the present invention, in addition to the effects of the invention according to the first aspect of the present invention, a plurality of secondary after-air guide vanes (15) are attached at the same angle, such that the secondary after-air (11) can spread toward right and left in the horizontal direction with a simple configuration, to be supplied to the vicinity of the furnace wall.

In accordance with the fourth aspect of the present invention, in addition to the effects of the invention according to the first aspect of the present invention, in a device having a plurality of secondary after-air guide vanes (15) on each of right and left in the horizontal direction, the secondary after-air guide vanes (15) may have any deviation in the inclination angle thereof with respect to the central axis ($C_0$), and thereby it is possible to more finely set the direction in which the secondary after-air (11) is injected.

In accordance with the fifth aspect of the present invention, in addition to the effects of the invention according to the fourth aspect of the present invention, in the device having a plurality of secondary after-air guide vanes (15) on each of right and left, the inclination angle of the secondary after-air guide vanes (15) with respect to the central axis ($C_0$) of the after-air port becomes larger with increasing distance away from the primary after-air nozzle (5), the secondary after-air (11) which is supplied in a direction changed by the secondary after-air guide vanes (15) on a side away from the primary after-air nozzle (5) is supplied to a region near the front and rear walls of the furnace, and the secondary after-air (11) which is supplied in a direction changed by the secondary after-air guide vanes (15) on a side near the primary after-air nozzle (5) is supplied to a region away from the front and rear walls of the furnace, such that it is possible to supply the secondary after-air (11) to wider area.

In accordance with the sixth aspect of the present invention, in addition to the effects of the invention according to any one of the first to fifth aspects of the present invention, the secondary after-air guide vanes (15) are configured to change the inclination angle thereof, and thereby the injection direction of the secondary after-air (11) to be deflected right and left in the horizontal direction can be optimally controlled through a trial operation, and the like.

In accordance with the seventh aspect of the present invention, in addition to the effects of the invention according to any one of the first to sixth aspects of the present invention, it is possible to move the secondary after-air guide vane (15) in the anteroposterior direction of the furnace, and control an influence degree of the spreading part (18) of the opening (17) of the after-air port to which the secondary after-air (11) collides, and thereby optimally control the injection direction of the secondary after-air (11).

In accordance with the eighth aspect of the present invention, in addition to the effects of the invention according to any one of the first to seventh aspects of the present invention, a small amount of secondary after-air (11) can be supplied to a portion nearest the primary after-air nozzle (5) by the first guide member (16) along the surface of the secondary after-air guide vane (15) on the furnace side thereof and the outer surface of the tip part of the primary after-air nozzle (5), and adhesion of the combustion ash to the surface of the secondary after-air guide vanes (15) on the furnace side thereof and the outer surface of the tip part of the primary after-air nozzle (5) can be suppressed, and thereby the flow patterns of the primary after-air (1) and the secondary after-air (11) can be stably maintained.

In accordance with the ninth aspect of the present invention, in addition to the effects of the invention according to any one of the first to eighth aspects of the present invention, a small amount of the secondary after-air (11) can be supplied by the second guide member (19) along the surface of the spreading part (18) of the opening (17) of the after-air port, which spreads toward the furnace, and the adhesion of the combustion ash to the spreading part (18) can be suppressed, and thereby the flow of the secondary after-air (11) having stable spreadability can be maintained.

In accordance with the tenth aspect of the present invention, in addition to the effects of the invention according to any one of the first to ninth aspects of the present invention, by providing the air flow rate control functional members (3 and 12) capable of changing the flow path resistance in any one or both of the inlet part of the primary after-air nozzle (5) and the inlet parts of the secondary after-air nozzles (14), it is possible to optimally control the flow rate of the primary after-air (1) and the secondary after-air (11).

In accordance with the eleventh aspect of the present invention, in addition to the effects of the invention according to any one of the first to tenth aspects of the present invention, by attaching the contracting member (5*a*) having a flow passage cross-sectional area gradually decreased in the flow direction of air to the inlet part of the primary after-air nozzle (5), the flow path resistance in the inlet part of the primary after-air nozzle (5) can be reduced, and thereby it is possible to reduce a differential pressure required for supplying the after-air, that is, reduce energy. In addition, when using the same differential pressure for supplying the after-air, it is possible to increase the velocity of the primary after-air (1), and thereby effectively promote the mixing of the primary after-air (1) in the furnace.

In accordance with the twelfth aspect of the present invention, in addition to the effects of the invention according to any one of the first to eleventh aspects of the present invention, the horizontal width of the tip part of the primary after-air nozzle (5) is gradually decreased in the flow direction of air by the contracting member (5*b*), such that, when the secondary after-air guide vanes (15) have a small inclination angle with respect to the central axis ($C_0$) of the after-air port, the jet of the primary after-air (1) and the jets of the secondary after-air (11) can be reliably separated from each other, and thereby the penetration of the primary after-air (1) and the spreadability of the secondary after-air (11) can be maintained.

In accordance with the thirteenth aspect of the present invention, in addition to the effects of the invention according to any one of the first to twelfth aspects of the present invention, the rectifiers (4 and 13) made of a porous plates, and the like are installed in the flow paths of any one or both of the primary after-air nozzle (5) and the secondary after-air nozzles (14), such that, even when nonuniformity of the after-air flow distribution exists in the inlet part of the flow path, uniform flow can be formed at the outlets of the nozzles by the rectifiers, and the penetration of the primary after-air (1) and the spreadability of the secondary after-air (11) can be maintained.

In accordance with the fourteenth aspect of the present invention, in addition to the effects of the invention according to any one of the first to thirteenth aspects of the present invention, since the opening (17) of the after-air port has the rectangular shape, the primary after-air nozzle (5), the secondary after-air flow rate regulating damper (12), and the like may be formed in a rectangular shape, and thereby it is effective in terms of reduction in manufacturing costs.

In accordance with the fifteenth aspect of the present invention, in addition to the effects of the invention according to any one of the first to thirteenth aspects of the present invention, since the opening (17) of the after-air port is formed in a polygonal shape, it is possible to have a configuration in which the secondary after-air flow rate regulating damper (12), and the like may be formed in a polygonal shape, and thereby it is effective in terms of reduction in manufacturing costs.

DESCRIPTION OF EMBODIMENTS

Before describing specific examples of the present invention, FIG. 16, which is views illustrating shapes (a concentration distribution) of an after-air jets, when supplying after-air through nozzles having openings with various shaped cross-sections at the same velocity among combustion gas flowing upward in the furnace, will be described.

Figure 16:
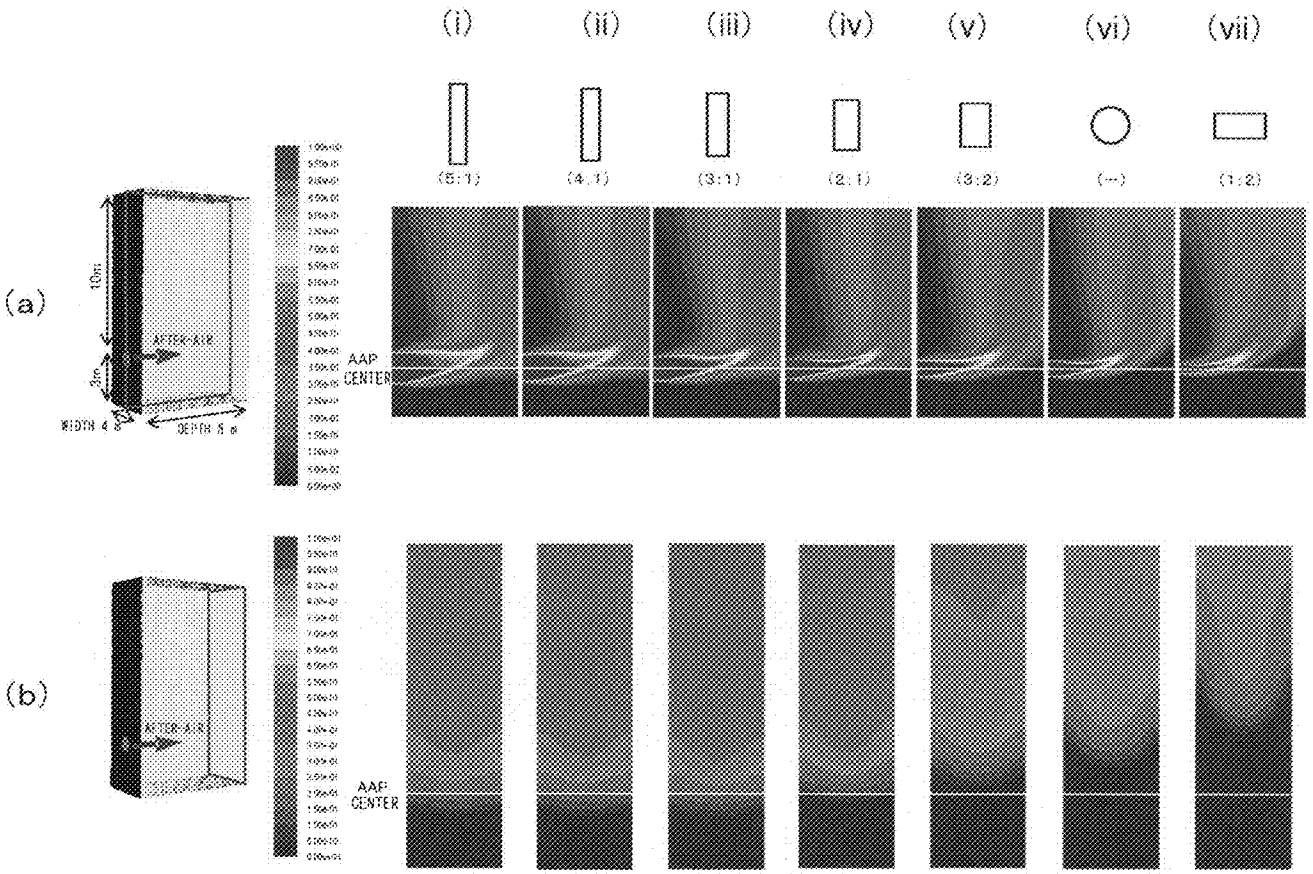
FIG. 16 is views illustrating concentration distributions of the after-air in the vertical plane passing through the central axis of the air port due to difference in an outlet shape of the after-air ports installed on the furnace wall (FIG. 16(*a*)), and views illustrating the concentration distribution of the after-air in the surface orthogonal to the central axis of the air port in a furnace depth center (FIG. 16(*b*)).

FIG. 16 illustrates numerical flow analysis results, wherein FIG. 16(*a*) illustrates the shapes and the concentration distributions of the after-air jets in the vertical plane passing through the air port central axis Co (see FIG. 2) in relation to difference in the outlet shapes of the after-air ports installed on the furnace wall, and FIG. 16(*b*) illustrates the shapes and the concentration distributions of the after-air jets in the plane orthogonal to the air port central axis Co at the furnace depth center. The left parts of FIGS. 16(*a*) and (*b*) illustrate the scope of the analysis model.

The present analysis model covers a range obtained by cutting a portion of the furnace including one after-air port, which is a rectangular body having a width of 4 m, a height of 13 m, and a depth of 8 m. Herein, the after-air port is installed in a widthwise center at a position of a height of 3 m from the bottom, and the after-air is supplied in a direction illustrated by an arrow in FIG. 16(*a*) from the after-air port. The furnace depth is 16 m, and a position of 8 m from the after-air port is the center in the depth direction, and this model is set to be a half in the depth direction. The boundary on both sides and a depth side of the model scope is defined as a condition of a mirror symmetry, and it is possible to simulate an actual flow in the furnace.

In addition, FIGS. 16(*a*) and (*b*) illustrate the scope of the analysis model in the left portion thereof, and contrasting densities (actually expressed by a difference in color) obtained by representing an air concentration of the after-air in a strip shape and showing it in a dimensionless way as an after-air mass distribution in the right portion thereof. It is shown in red toward the top and in blue toward the bottom, the top is 100% and the bottom is 0%.

The combustion gas rising from a burner (not illustrated) is defined as flow upward at uniform velocity for simplification. As illustrated in FIG. 16, an after-air supply nozzle has a cross-sectional shape of total of seven types including: (vii) horizontally long rectangular shape (an aspect ratio of 1:2, wherein "vertical" of the "aspect ratio" refers to the vertical length of the nozzle, and "horizontal" thereof refers to the horizontal length of the nozzle); (vi) a circular shape; and (i) to (v) vertically long rectangular shapes (five types of aspect ratios of (v) 3:2, (iv) 2:1, (iii) 3:1, (ii) 4:1 and (i) 5:1).

The cross-sectional area and an ejected flow rate of the after-air supply nozzle (hereinafter, simply referred to as a nozzle) are the same for all the seven types of nozzles. The jet of after-air injected into the furnace is bent to the upper side due to the flow of the combustion gas rising in the furnace. The cross-sectional shape of the after-air immediately after the injection is the same as the nozzle, but as the horizontal length of the shape is larger, it may be easily affected by the combustion gas flow rising in the furnace, and may be bent rapidly upward. That is, after-air jets are bent by the combustion gas flow rising in the furnace rapidly to the upper side in an order of a horizontally long rectangular, circular, and vertically long rectangular.

In the case that the aspect ratio of the nozzle is larger than 3:1 (3/1), a saturation tendency is observed in the characteristics that the after-air jet is bent to the upper side due to an increase in a resistance of both sides of the jet. The rising combustion gas flow bent to the upper side is the model which is referred to as the mirror symmetry in the furnace depth direction, such that the jets injected from the after-air ports 7*a* which are disposed in a pair of the opposed furnace walls collide at the position of 8 m which is a central position in the furnace depth direction (the position recessed to 8 m from the furnace wall in the depth direction), and then rise upward.

Mixing and combustion reaction of the combustion gas containing the after-air and unburned components proceed in the upper side of the after-air jet. If the after-air jet is rapidly bent to the upper side, a space from the after-air jet required for mixing and combustion reaction to the furnace outlet is decreased, and as a result, an unburned component residual rate is increased. Reversely, when it is difficult for the after-air jet to be bent to the upper side, it is possible to secure the space from the after-air jet required for mixing and combustion reaction to the furnace outlet, and the unburned component residual rate is kept low.

When supplying the after-air using a nozzle having a shape with a small horizontal width and a large vertical height, it is possible to reduce an influence of the flow of the combustion gas rising in the furnace, improve penetration thereof due to bending of the flow of the combustion gas to the upper side being reduced, and secure the space from the after-air jet to the furnace outlet, which is required for mixing and combustion reaction of the combustion gas containing unburned components and the after-air, such that it is possible to achieve high efficiency combustion with a lower residual rate of the unburned components.

Figure 15:
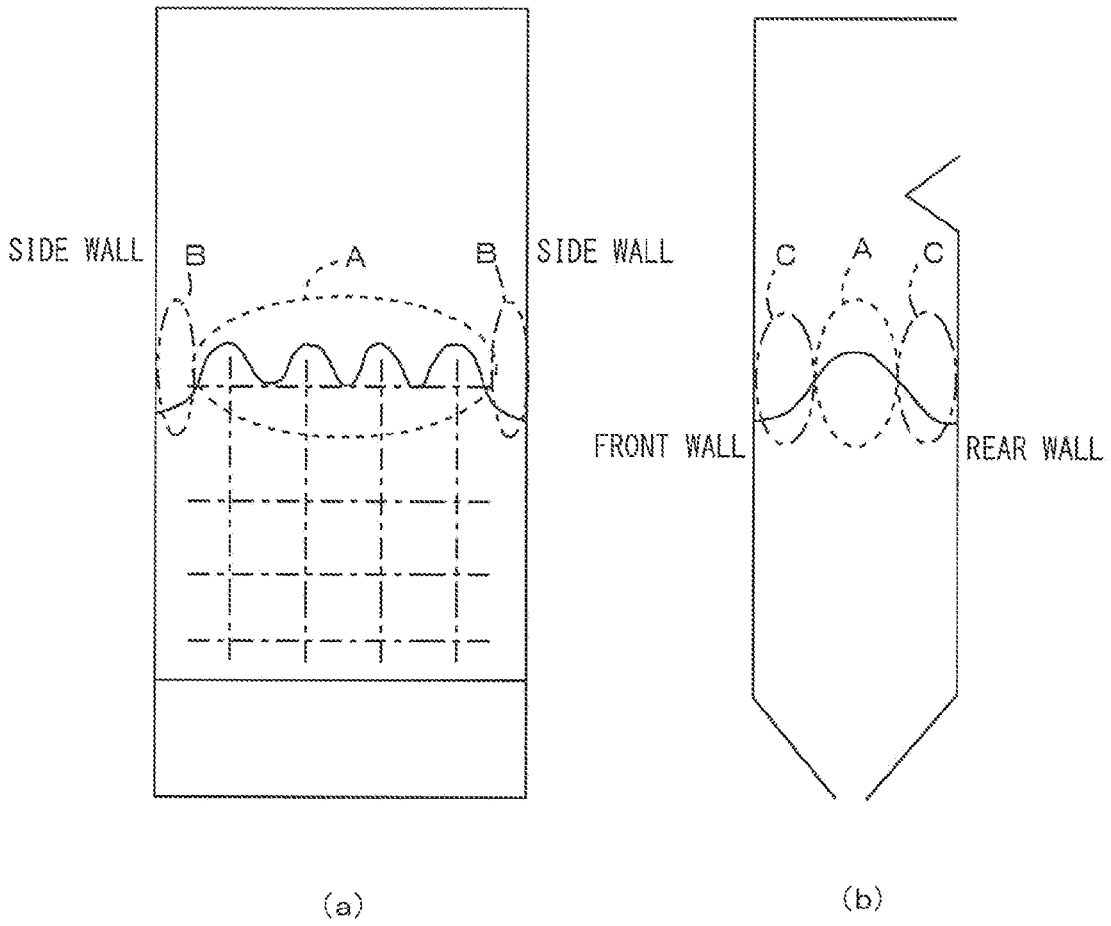
FIG. 15 includes a front sectional view of the furnace for describing a flow rate distribution of the rising gas in a horizontal section in the furnace immediately below the after-air ports illustrated in FIG. 14 (FIG. 15(*a*)), and a side sectional view thereof (FIG. 15(*b*)).

In addition, only by using the nozzle having a shape with a small horizontal width and a large vertical height, it is effective for reducing the unburned components. However, by effectively supplying the after-air to the combustion gas containing the unburned components of the region (the regions C illustrated in FIG. 15(*b*)) in the vicinity of the furnace front wall and the furnace rear wall between the after-air jets, high efficiency combustion with being further reduced the unburned components can be realized.

The above-described problems in Patent Literature 1 and Patent Literature 2 will be additionally described based on a difference in the flow pattern in the furnace of the jet due to a difference in the jet shape.

When applying the after-air port structure according to Patent Literature 1, an after-air jet having an integral type of an end-spreading shape in the horizontal direction is formed, and the cross-sectional shape of the after-air jet immediately after the injection becomes a horizontally wide shape (with a small aspect ratio), and as illustrated in FIG. 16 (*a*)(vii) and FIG. 16 (*b*)(vii), is rapidly bent to the upper side due to the rising gas flow in the furnace. Therefore, it cannot be said that this kind of after-air jet is an appropriate shape for maintaining the penetration.

The present invention defines the after-air port which has two functions of a primary after-air (1) governing the penetration and a secondary after-air (11) governing the spreadability, but which is basically different from the invention described in Patent Literature 1 in terms of that, by completely separating two types of after-air jets having the penetration and the spreadability to cut off the continuity of the two types of jets, and by eliminating the interaction between the two types of jets, it is possible to maintain the penetration and the spreadability.

When applying the after-air port structure according to the invention described in Patent Literature 2, the after-air jet of the after-air port outlet part has a circular cross-sectional shape, and as compared to FIG. 16 (*a*)(vi) and FIG. 16 (*b*)(vi) and the rectangular shape having a large vertical/horizontal ratio (FIG. 16 (*a*)(i) to (v) and FIG. 16 (*b*)(i) to (v)), the penetration is deteriorated, and there is room for improvement.

EXAMPLE 1

Figure 1:
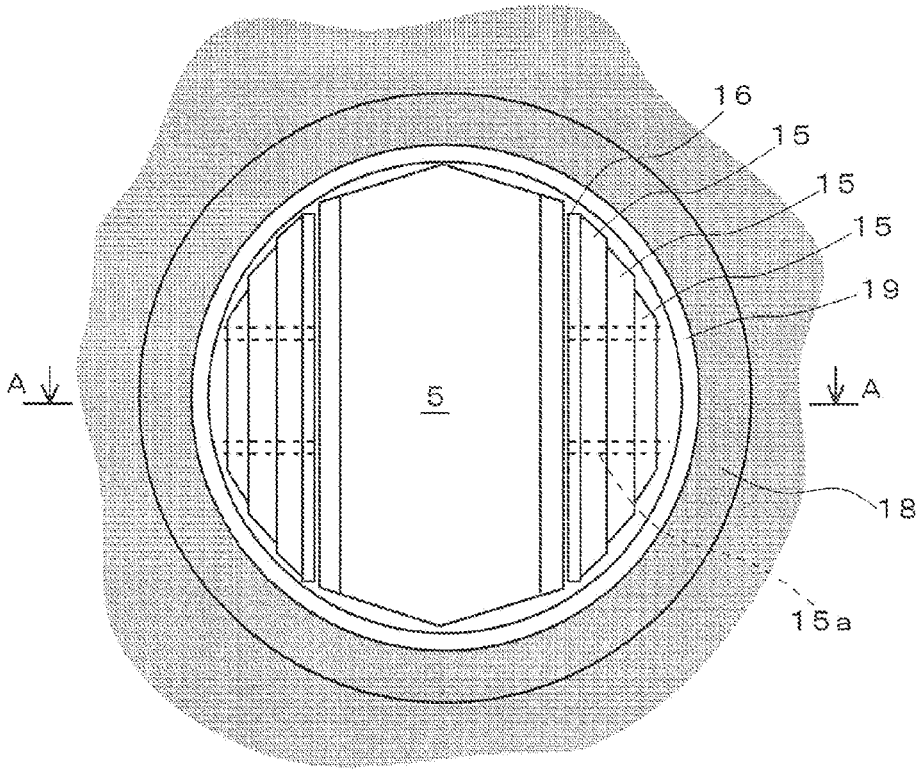
FIG. 1 is a front view of an after-air port according to one example of the present invention as viewed from the furnace side (FIG. 1(*a*)), and a view taken in the arrow direction of line A-A in FIG. 1(*a*) (FIG. 1(*b*)).
Figure 1:
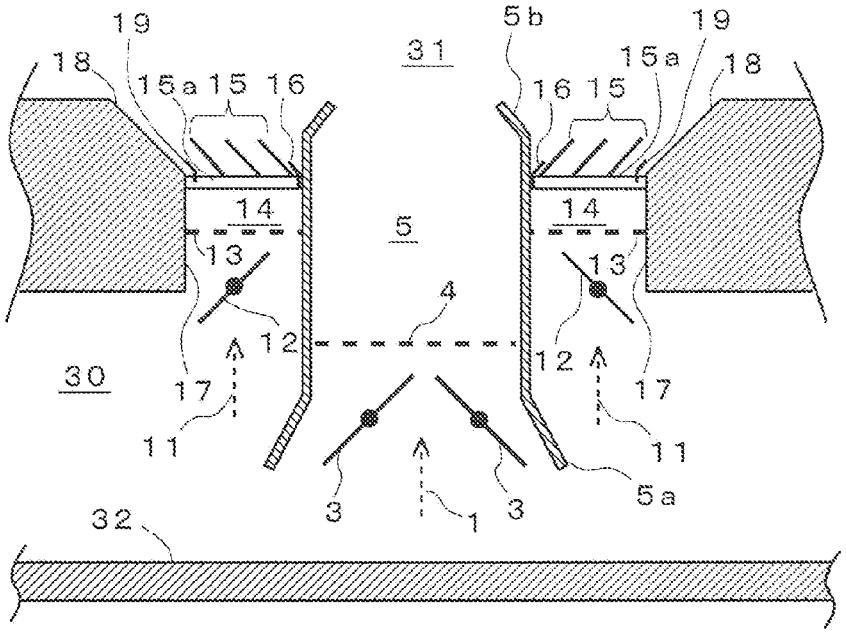

FIG. 1 illustrates an after-air port according to one example of the present invention, wherein FIG. 1(*a*) is a front view as viewed from the furnace (31) side, and FIG. 1(*b*) is a cross-sectional view taken in the arrow direction of line A-A in FIG. 1(*a*).

In the after-air port illustrated in FIG. 1, after-air in a wind box (30) for after-air (the wind box (30) represents an entire space surrounded by a wind box casing (32) and the furnace wall) is divided into primary after-air (1) and secondary after-air (11), and the primary after-air (1) and the secondary after-air (11) are supplied to the furnace (31) via a primary after-air nozzle (5) and secondary after-air nozzles (14), respectively. The primary after-air nozzle (5) includes a primary after-air nozzle inlet contracting member (5*a*) which is installed in an inlet thereof and has a cross-sectional area gradually decreased toward the flow direction, to suppress a pressure loss in the inlet of the primary after-air nozzle (5). Further, the primary after-air nozzle (5) includes primary after-air flow rate control dampers (3) which are installed in the inlet part thereof and are capable of changing a flow path resistance, to optimally control the flow rate of the primary after-air (1).

The primary after-air nozzle (5) includes a primary after-air rectifier (4) which is installed inside thereof and made of a plate material provided with a plurality of through holes. Even when deviation in the velocity distribution may exist in the primary after-air (1) at the inlet part of the primary after-air nozzle (5), it is uniformly rectified to a uniform flow by the primary after-air rectifier (4), and thus the primary after-air (1) is supplied to the furnace (31) as a jet having a stable penetration.

In addition, the secondary after-air nozzles (14) include secondary after-air flow rate control dampers (12) which are installed in the inlet parts thereof and are capable of changing the flow path resistance, thereby enabling the optimum control of the flow rate of the secondary after-air (11). Secondary after-air rectifiers (13), which are made of plate material provided with a plurality of through holes, are installed in the outlets of the secondary after-air flow rate control dampers (12). Even when deviation in the velocity distribution may occur at the inlet parts of the secondary after-air nozzles (14), it is uniformly rectified to uniform flows by the secondary after-air rectifiers (13) and introduced via secondary after-air guide vanes (15), and thus the secondary after-air (11) is supplied to the furnace (31) as jets having a stable penetration.

The primary after-air nozzle (5) may include one or more partition plates (not illustrated) provided inside thereof and having flat plates in a gas flow direction, instead of the primary after-air rectifier (4), such that a rectifying effect can be obtained by separating the inside of the primary after-air nozzle (5) into a plurality of flow passages. Even when deviation in the velocity distribution may exist at the inlet part of the primary after-air nozzle (5), it is rectified to a straight flow, and thus the primary after-air (1) is supplied to the furnace (31) as a jet having a stable penetration.

Figure 2:
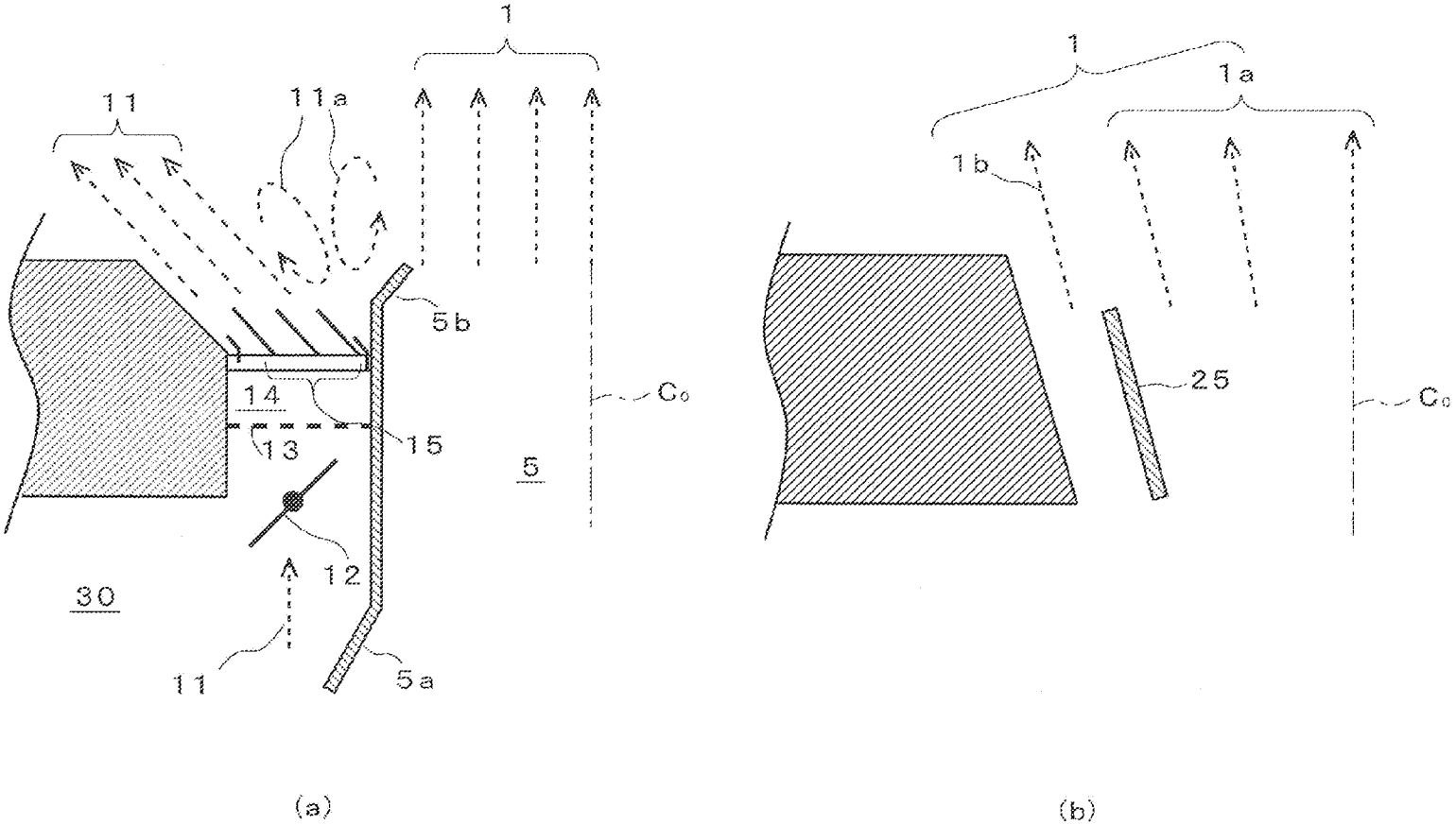
FIG. 2 is a plan sectional view of a left half of a tip part of the after-air port according to one example of the present invention (FIG. 2(*a*)), and a plan sectional view of a left half of a tip part of an after-air port known in the related art (Patent Literature 1) (FIG. 2(*b*)).

Herein, a difference in the flow of the after-air jet at the outlet part of the after-air port between the present example and the above-described invention stated in Patent Literature 1 will be again described using FIG. 2. FIG. 2 shows views for comparing plan cross-sections of structure examples of tip parts of the after-air ports and jet pattern examples of the outlet part with left halves from the central axes, between the present example (FIG. 2(*a*)) and the invention described in Patent Literature 1 (FIG. 2(*b*)).

In the after-air port by the invention described in Patent Literature 1, as illustrated in FIG. 2(*b*), the flow direction of the after-air is straight in the vicinity of the central axis of an after-air main flow (1*a*), but gradually spreads toward the horizontal outside, to form a continuous united after-air jet with an after-air sub flow (1*b*) separated from the after-air main flow (1*a*) by an air separation plate (25). Compared to this, in the after-air port by the present example, as illustrated in FIG. 2(*a*), the primary after-air (1) flowing through the primary after-air nozzle (5) and the secondary after-air (11) flowing through the secondary after-air nozzles (14) are present as independent jets having two type directions of a straight direction and a direction with an horizontal inclination angle, and a circulation vortex (11*a*) which is a pair of secondary flows is formed therebetween. As seen above, due to the flow pattern of the after-air (1) and (11) in the present example, the penetration and the spreadability of the after-air (1) and (11) is maintained. Further, a formation of the above-described secondary flow (circulation vortex) (11*a*) is a phenomenon in which the combustion gas around the after-air (1) and (11) are accompanied by (drawn in) the jets of the primary after-air (1) and the secondary after-air (11), and plays an important role in terms of facilitating the mixing of the combustion gas containing the unburned components with the after-air (1) and (11).

EXAMPLE 2

Figure 3:
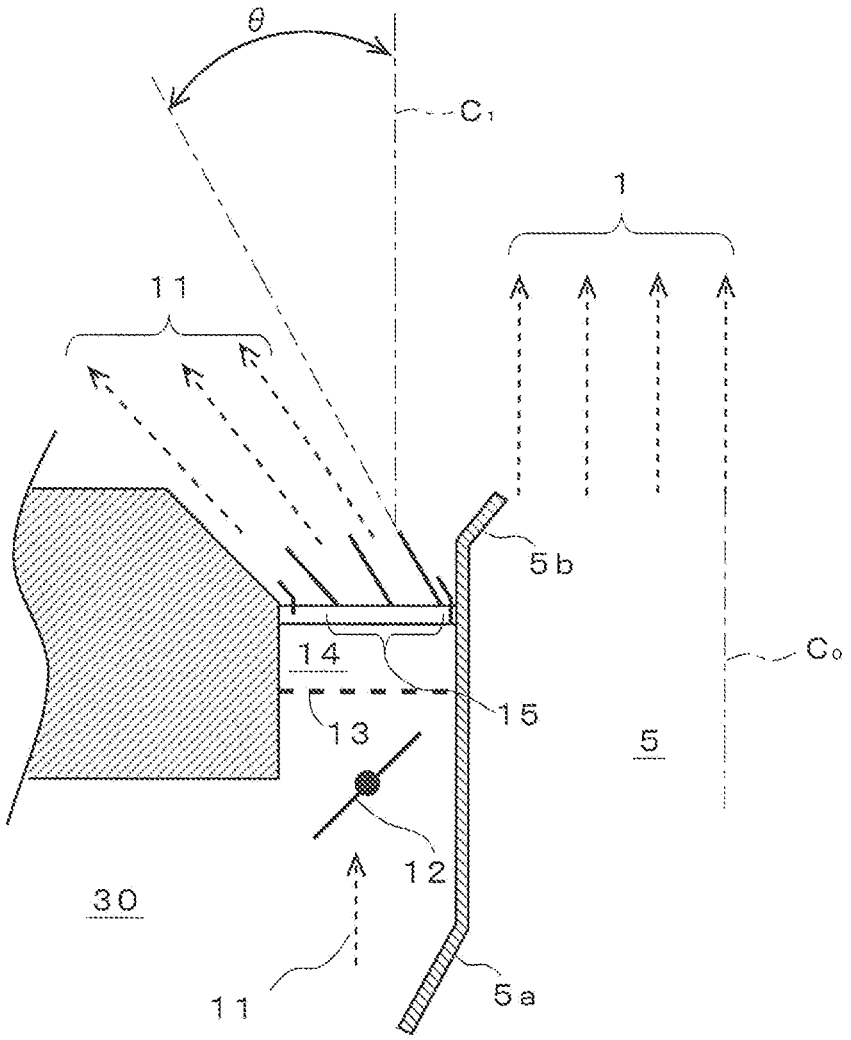
FIG. 3 is a plan sectional view of a left half of a tip part of an after-air port according to another example of the present invention.

FIG. 3 illustrates an after-air port according to a second example of the present invention (illustrating a left half thereof). In the present example, the secondary after-air nozzles (14) has three secondary after-air guide vanes (15) on right and left, respectively. An inclination angle θ of the secondary after-air guide vanes (15) with respect to an axis $C_1$ parallel to the after-air port central axis $C_0$ becomes larger with increasing distance away from the primary after-air nozzle (5). The secondary after-air jets supplied into the furnace (31) with a direction being changed by the secondary after-air guide vanes (15) on the sides away from the primary after-air nozzle (5) are supplied to regions near the opposed furnace front and rear walls, and the secondary after-air jets supplied into the furnace (31) with a direction being changed by the secondary after-air guide vanes (15) on the sides near the primary after-air nozzle (5) are supplied to the regions away from the furnace front and rear walls, such that it is possible to supply the secondary after-air (11) to a wider region.

EXAMPLE 3

Figure 4:
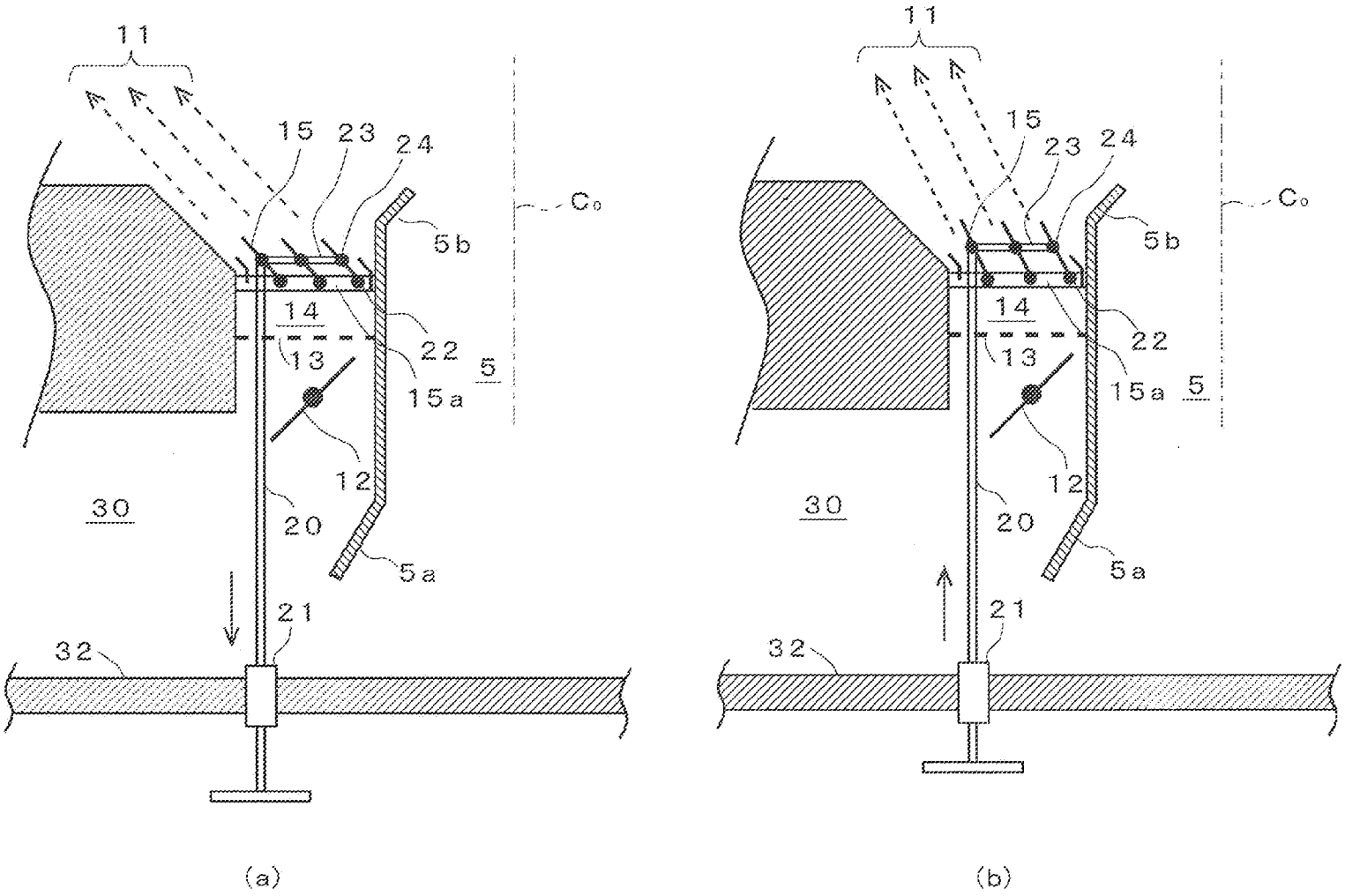
FIG. 4 is a plan sectional view of a left half of a tip part of an after-air port according to another example of the present invention in a case of relatively increasing an inclination angle of secondary after-air guide vanes (FIG. 4(*a*)), and a plan sectional view of the left half thereof in a case of relatively decreasing the inclination angle of the secondary after-air guide vanes (FIG. 4(*b*)).

FIG. 4 illustrates a third example of the present invention (illustrating a left half thereof). Three secondary after-air guide vanes (15) are installed on right and left, respectively, and rotation shafts (22) which pivot the secondary after-air guide vanes (15) to determine the inclination angle thereof are integrally provided in base parts of the secondary after-air guide vanes (15). Due to the rotation shaft (22), the secondary after-air guide vanes (15) are rotatably provided in a fixing member (15*a*).

Figure 5:
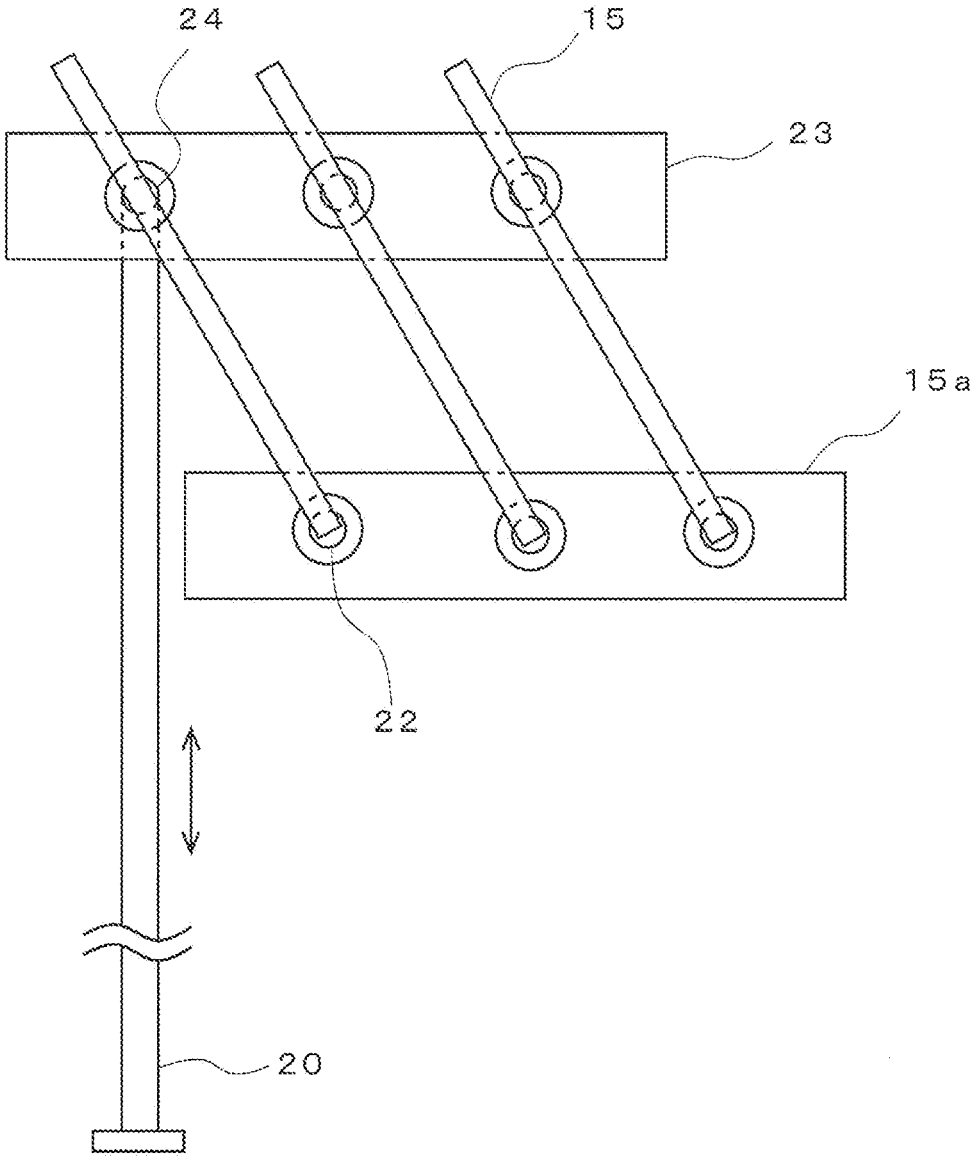
FIG. 5 is a view illustrating an operation mechanism of the secondary after-air guide vanes of the after-air port according to another example of the present invention.

FIG. 5 in a view illustrating an operation mechanism of the secondary after-air guide vanes (15).

A link (23) is also movable from side to side, and the inclination angle of the secondary after-air guide vanes (15) is changed in conjunction therewith. The rotation shafts (22) are pivotably attached to the fixing members (15*a*), and link rotation shafts (24) fixed to the tip of a lever (20) are pivotably provided in the link (23), such that the link (23) may move forward and backward by the lever (20).

The three secondary after-air guide vanes (15) are connected to the secondary after-air guide vane link (23) which connects the central parts of the respective guide vanes (15), and the link rotation shafts (24) which are provided in connection parts of the link (23) with the secondary after-air guide vanes (15). The inclination angle of the three secondary after-air guide vanes (15) may be simultaneously changed by pivoting the link rotation shafts (24) through the link (23) by an operation lever (20) which is provided by extending the tip of an operation member to the outside of the wind box casing (32).

With the secondary after-air guide vane operation lever (20) being pulled out (FIG. 4(*a*)), the spreading inclination angle of the secondary after-air guide vanes (15) is relatively increased, and the secondary after-air jet is close to the furnace front (rear) wall. Reversely, with the secondary after-air guide vane operation lever (20) being inserted (FIG. 4(*b*)), the spreading inclination angle of the secondary after-air guide vanes (15) is relatively decreased, and the secondary after-air jet is separated from the furnace front (rear) wall.

As described above, by controlling the position of the secondary after-air guide vane operation lever (20) in the back and front of the furnace wall surface, it is possible to optimally set the direction of the secondary after-air (11) to be deflected in a horizontal direction near the furnace wall surface. Since the secondary after-air guide vane operation lever (20) is installed by penetrating the wind box casing (32) for after-air, a secondary after-air guide vane operation lever through part seal (21) is provided in the wind box casing (32), so as to prevent the after-air from being leaked to the outside of the wind box (30).

EXAMPLE 4

Figure 6:
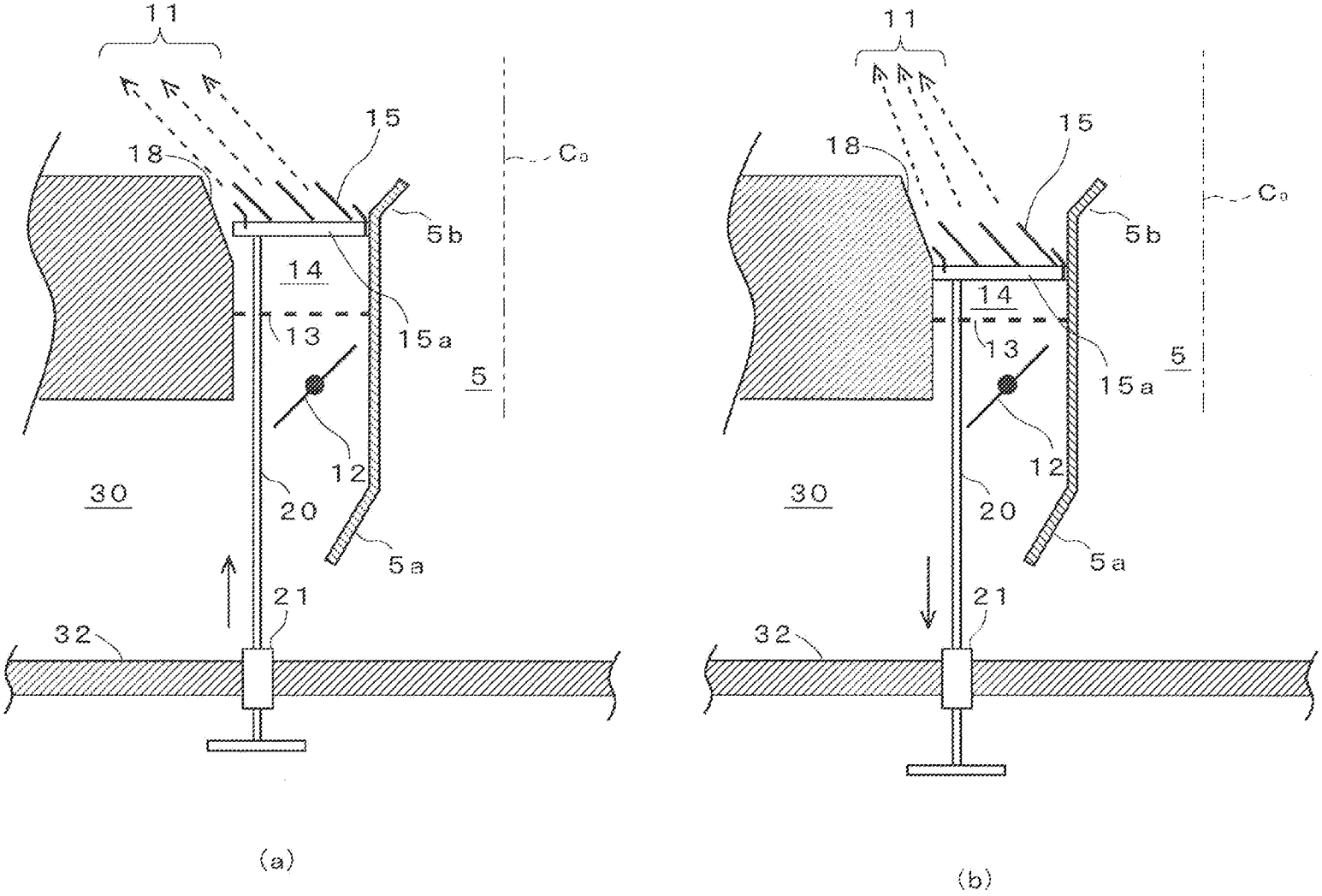
FIG. 6 is a plan sectional view of a left half of a tip part of an after-air port according to another example of the present invention, when the secondary after-air guide vanes are inserted to the furnace side (FIG. 6(*a*)), and a plan sectional view of the left half of the tip part thereof, when the secondary after-air guide vanes are pulled out from the furnace side (FIG. 6(*b*)).

FIG. 6 illustrates a fourth example of the present invention. Both of FIGS. 6(*a*) and (*b*) illustrate a left half of the after-air port plan horizontal cross-section, wherein FIG. 6(*a*) illustrates a case in which the secondary after-air guide vanes (15) is inserted toward the furnace side by the operation lever (20), and FIG. 6(*b*) illustrates a case in which the secondary after-air guide vanes (15) is pulled out from the furnace. Further, the same components as the members described in FIG. 1, and the like will be denoted by the same reference numerals, and therefore will not be described.

The secondary after-air guide vanes (15) illustrated in FIGS. 6(*a*)(*b*) are fixed to the fixing member (15*a*) so as not to be rotated.

With the secondary after-air guide vane operation lever (20) being inserted (FIG. 6(*a*)), the tip of the secondary after-air guide vanes (15) is inserted to a position of the furnace front (rear) wall, and the secondary after-air (11) is injected along the set inclination angle of the secondary after-air guide vanes (15) with no influence by the an after-air port opening spreading part (throat part) (18).

With the secondary after-air guide vane operation lever (20) being pulled out (FIG. 6(*b*)), the tip of the secondary after-air guide vanes (15) is a position in which it moves from the furnace front (rear) wall to the wind box (30) side, and the secondary after-air (11) is affected by the after-air port opening spreading part (18). The secondary after-air (11) supplied from the outside of the secondary after-air guide vanes (15) farthermost from the primary after-air nozzle (5) forms a flow while suppressing the spread along an inner surface of the after-air port opening spreading part (18).

The influence of the after-air port opening spreading part (18) also affects the secondary after-air (11) supplied from the secondary after-air guide vanes (15) on the side near the primary after-air nozzle (5), and as compared to FIG. 6(*a*), the secondary after-air jet is supplied in a direction toward the inside of the furnace away from the furnace front (rear) wall as a whole.

Therefore, by controlling the position of the secondary after-air guide vane operation lever (20) in the back and front, it is possible to control an influence degree of the after-air port opening spreading part (18), and optimally set the direction of the secondary after-air (11). In the present example, since the direction of the secondary after-air (11) is controlled using the influence of the after-air port opening spreading part (18), the spreading inclination angle of the after-air port opening spreading part (18) is set to be smaller than that of the example disclosed in FIG. 4.

EXAMPLE 5

Figure 7:
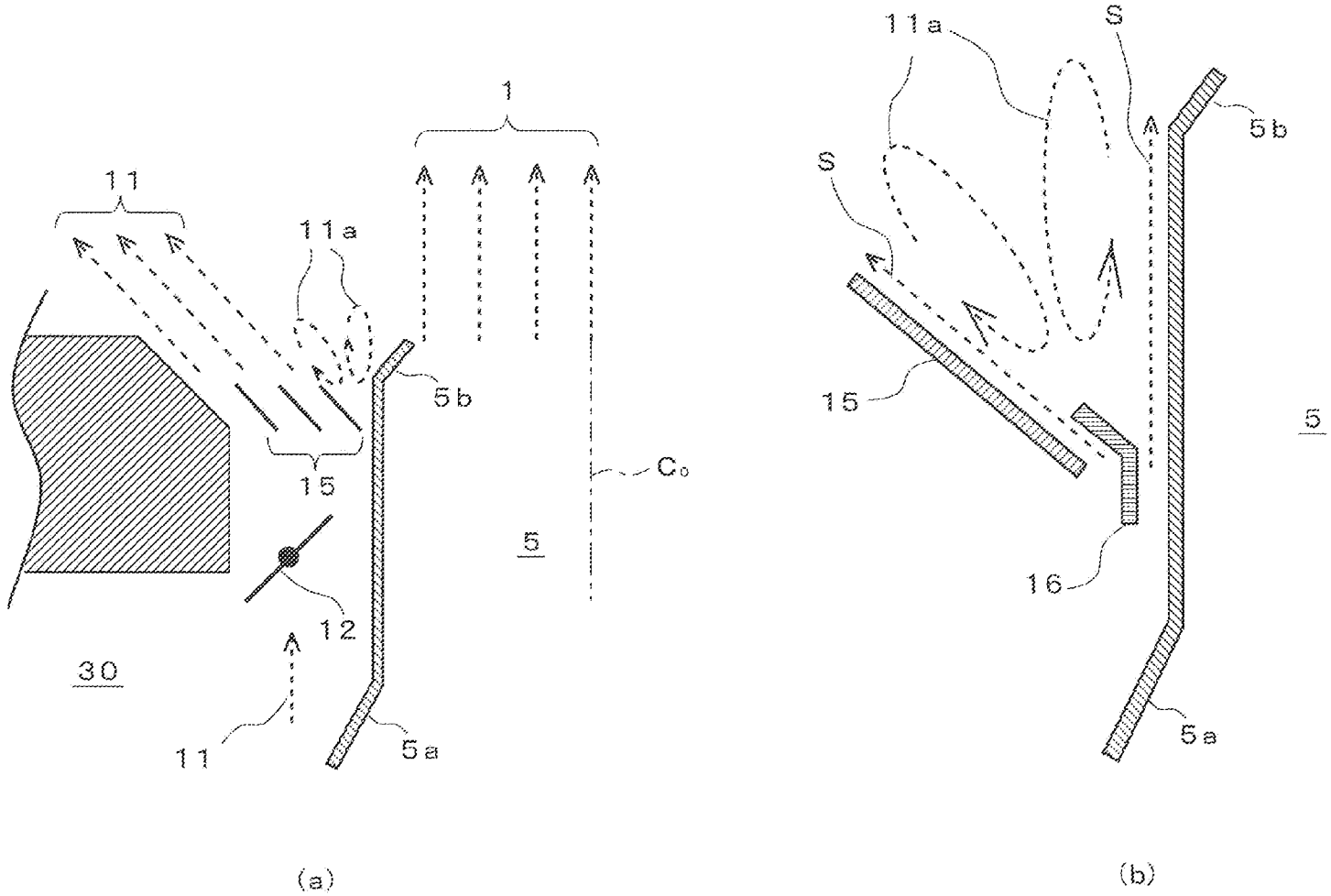
FIG. 7 is a plan sectional view of a left half of a tip part of an after-air port according to another example of the present invention, when a guide member is not installed in a secondary after-air nozzle (FIG. 7(*a*)), and a detailed plan sectional view of the left half of the tip part thereof around the guide member, when a first guide member is installed in the secondary after-air nozzle (FIG. 7(*b*)).

FIG. 7 illustrates a fifth example of the present invention. Effects when installing a first guide member (16) will be described. FIG. 7(*a*) is a plan sectional view illustrating a left half of a tip part of an after-air port, when the first guide member (16) is not installed, and FIG. 7(*b*) is a detailed plan sectional view of the left half of the tip part of the after-air port around the first guide member (16), when the first guide member (16) is installed.

As illustrated in FIG. 7(*a*), the secondary flow (circulation vortex 11*a*) between the primary after-air jet and the secondary after-air jet is formed by contacting with the tip part of the primary after-air nozzle (5) and a portion of the secondary after-air guide vanes (15) facing the furnace nearest to the primary after-air nozzle (5), and molten ash suspended in the secondary flow (circulation vortex (11*a*)) are adhered to the tip part of the primary after-air nozzle (5) and the portion of the secondary after-air guide vanes (15) facing the furnace nearest to the primary after-air nozzle (5).

The ash adhered to the furnace side surface gradually grow to become a cause of inhibiting the stable formation of the primary after-air jet and the secondary after-air jets. As illustrated in FIG. 7(*b*), a small interval is provided between the tip part of the primary after-air nozzle (5) and the portion of the secondary after-air guide vanes (15) facing the furnace nearest to the primary after-air nozzle (5), and the first guide member (16) is installed in the interval, such that a small amount of sealing air (S) illustrated by arrows is normally supplied along the outer surface of the tip part of the primary after-air nozzle 5 and the portion of the secondary after-air guide vanes (15) facing the furnace (31) nearest to the primary after-air nozzle (5). Therefore, contact and adherence of the molten ash suspended in the secondary flow (circulation vortex (11*a*)) can be suppressed so as to form stable after-air jets.

The effects of a second guide member (19) illustrated in the drawings other than FIG. 1 will not be described in detail, but due to the same effects as the above-described effects, a small amount of sealing air is normally supplied to the after-air port opening spreading part (18). Therefore, the adherence of the ash to the after-air port opening spreading part (18) can be suppressed so as to form stable secondary after-air jets.

EXAMPLE 6

Figure 8:
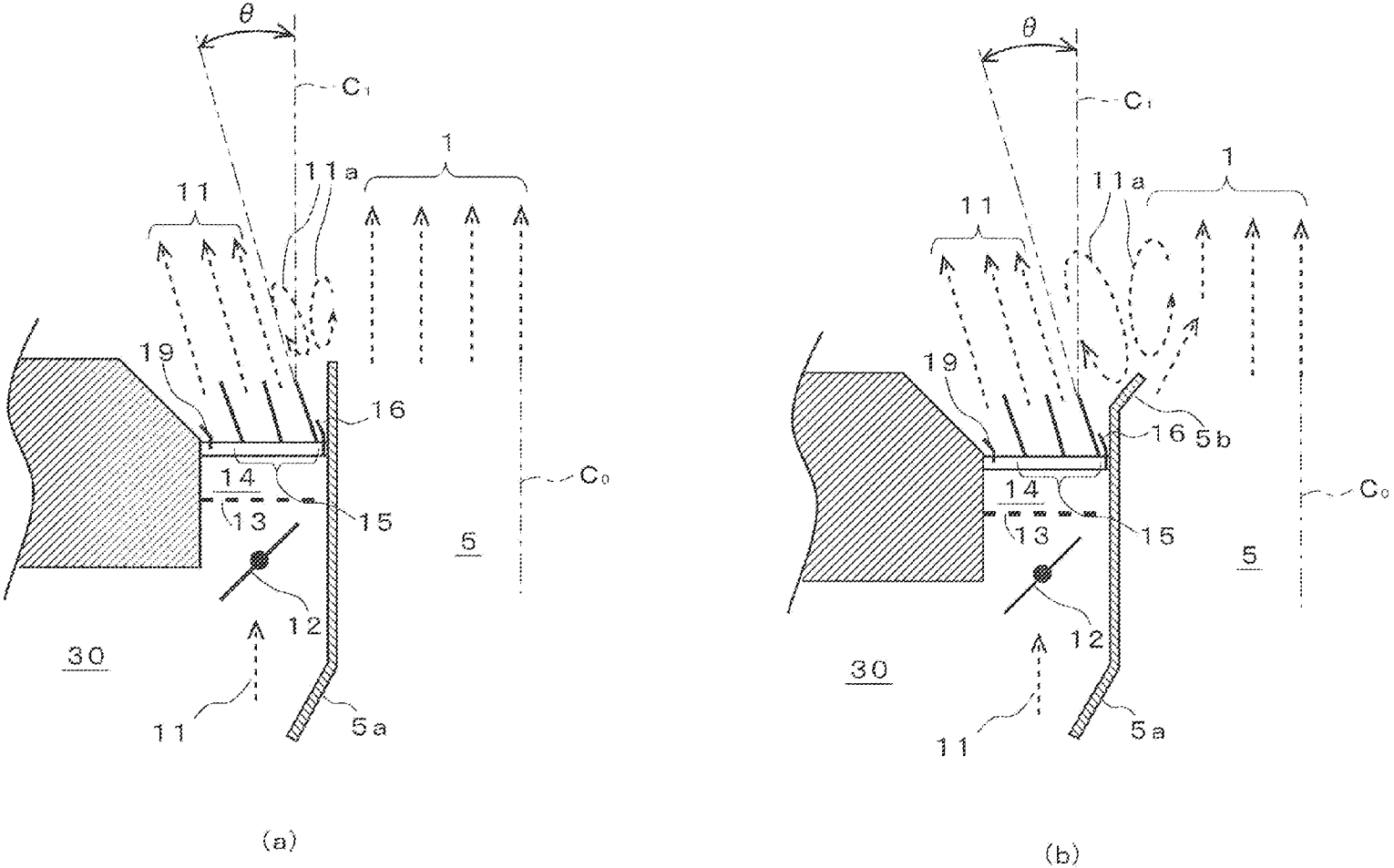
FIG. 8 is a plan sectional view of a left half of a tip part of an after-air port according to another example of the present invention in a case of without a primary after-air nozzle outlet contracting member (FIG. 8(*a*)), and a plan sectional view of the left half of the tip part thereof in a case of including the primary after-air nozzle outlet contracting member (FIG. 8(*b*)).

A sixth example of the present invention will be described using FIG. 8. FIG. 8(*a*) is a plan sectional view illustrating the left half of a tip part of an after-air port when an outlet contracting member (5*b*) is not provided in the primary after-air nozzle (5), and FIG. 8(*b*) is a plan sectional view illustrating the left half of the tip part of the after-air port when the outlet contracting member (5*b*) is provided therein.

When the inclination angle θ with respect to the axis $C_1$ parallel to the after-air port central axis $C_0$ of secondary after-air guide vanes (15) is small, as illustrated in FIG. 8(*a*), a space between the jets of the primary after-air (1) and the secondary after-air (11) is decreased, and there is a case in which forming the secondary flow (circulation vortex (11*a*)) is difficult, or although the secondary flow (circulation vortex (11*a*)) is formed, stably forming the same is difficult. In such a case, separation of the secondary after-air (11) from the primary after-air (1) is difficult or unstable, such that a so-called penetration in the primary after-air (1) and spreadability in the secondary after-air (11) which are the basic configuration of the present invention are difficult to be achieved, or effects thereof are reduced.

Therefore, by providing the outlet contracting member (5*b*) of the primary after-air nozzle (5) on the tip of the primary after-air nozzle (5), as illustrated in FIG. 8(*b*), even when the inclination angle θ of secondary after-air guide vanes (15) with respect to the axis $C_1$ parallel to the after-air port central axis $C_0$ is small, it is possible to form the space between the jets of the primary after-air (1) and the secondary after-air (11), and form the stable secondary flow (circulation vortex (11*a*)), such that a so-called penetration in the primary after-air (1) and spreadability in the secondary after-air (11) which are the basic configuration of the present invention can be normally achieved.

EXAMPLE 7

Figure 9:
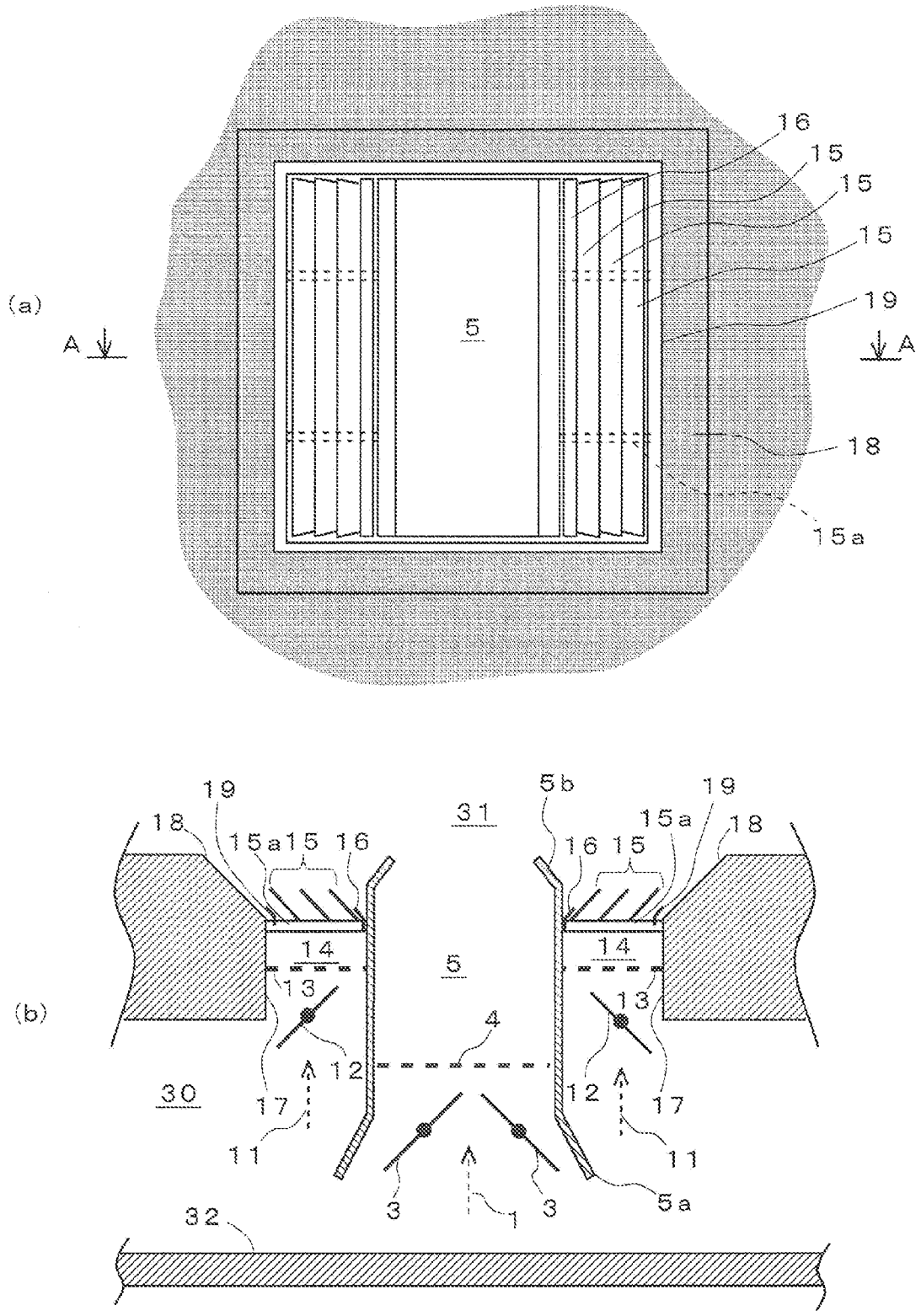
FIG. 9 is a front view of an after-air port having a rectangular opening according to another example of the present invention (FIG. 9(*a*)), and a cross-sectional view taken in the arrow direction of line A-A in FIG. 9(*a*) (FIG. 9(*b*)).

A seventh example of the present invention will be described using FIG. 9. FIG. 9(*a*) is a front view of an after-air port as viewed from the furnace (31) side of the after-air port provided on the furnace wall, and FIG. 9(*b*) is a cross-sectional view taken in the arrow direction of line A-A in FIG. 9(*a*).

In the after-air port illustrated in FIG. 9, the after-air is divided into a primary after-air (1) and a secondary after-air (11) from a wind box (30) for after-air, and the primary after-air (1) and the secondary after-air (11) are supplied to the furnace (31) via a primary after-air nozzle (5) and secondary after-air nozzles (14), respectively. The primary after-air nozzle (5) includes a primary after-air nozzle inlet contracting member (5*a*) which is installed in the inlet thereof and has a cross-section gradually decreased toward the flow direction, to suppress the pressure loss in the inlet of the primary after-air nozzle. The primary after-air nozzle (5) includes primary after-air flow rate control dampers (3) which are installed in an inlet part thereof and are capable of changing the flow path resistance, to optimally control the flow rate of the primary after-air (1).

The primary after-air nozzle (5) includes a primary after-air rectifier (4) which is installed inside thereof and made of a plate material provided with a plurality of through holes. Even when deviation of velocity distribution exists in the primary after-air (1) at the inlet part of the primary after-air nozzle (5), it is rectified to a uniform flow by the primary after-air rectifier (4), and thus the primary after-air (1) is supplied to the furnace (31) as a jet having stable penetration.

As illustrated in FIG. 9(*a*), the present example has a rectangular after-air port. By forming openings (17) and (18) in a rectangular shape, the primary after-air nozzle (5), the secondary after-air flow rate control dampers (12), the secondary after-air guide vanes (15), and the like may also be formed in rectangular shape. Therefore, it may be effective in terms of reduction in production costs, while achieving the function of the present invention.

EXAMPLE 8

Figure 10:
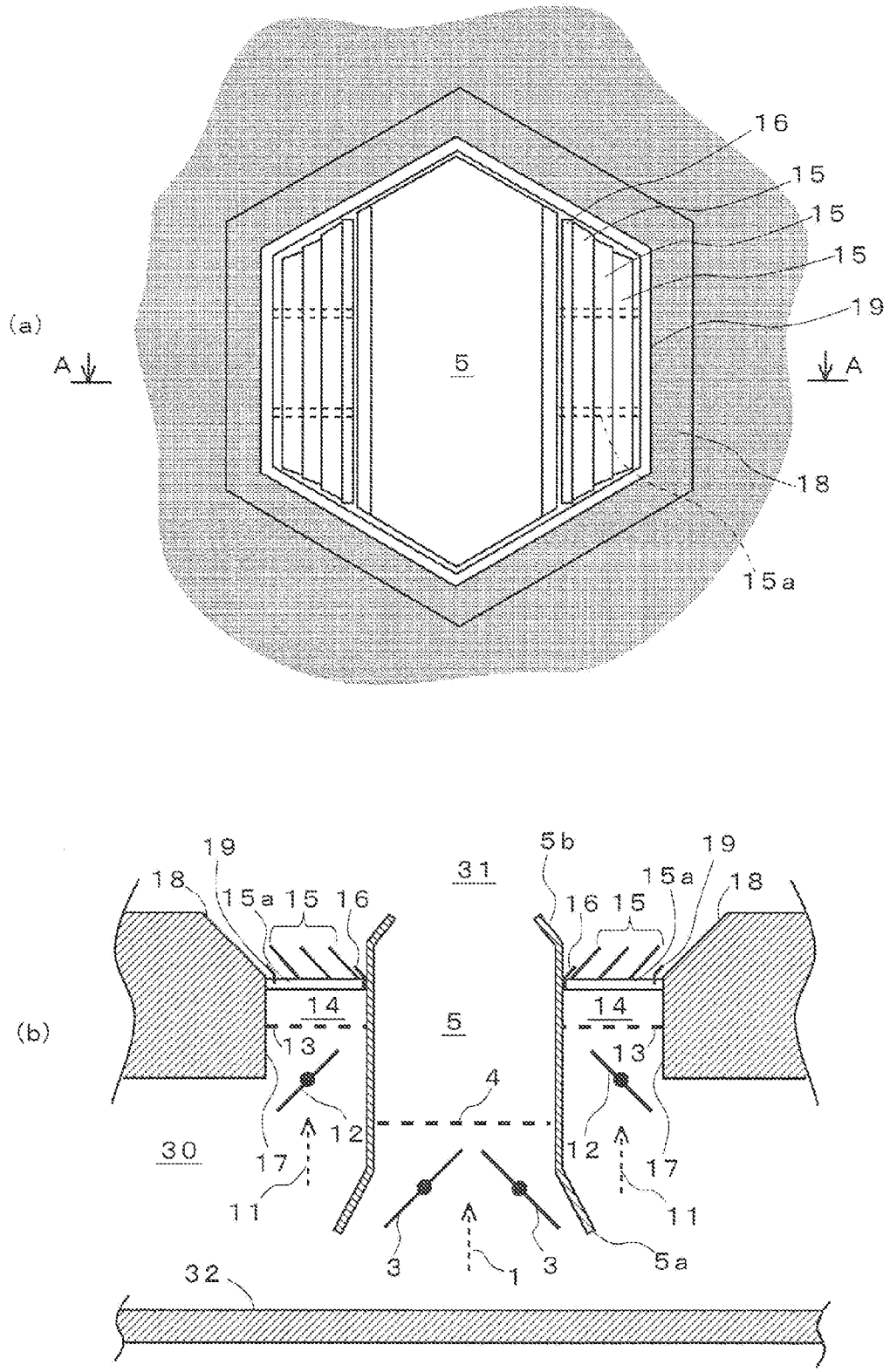
FIG. 10 is a front view of an after-air port having a hexagonal opening according to another example of the present invention (FIG. 10(*a*)), and a cross-sectional view taken in the arrow direction of line A-A in FIG. 10(*a*) (FIG. 10(*b*)).

An eighth example of the present invention will be described using FIG. 10. FIG. 10(*a*) is a front view of an after-air port as viewed from the inside of the furnace thereof, which is provided in the furnace wall, and (FIG. 10(*b*)) is a cross-sectional view taken in an arrow direction of line A-A in FIG. 10(*a*).

In the after-air port illustrated in FIG. 10, the after-air is divided into the primary after-air (1) and the secondary after-air (11) from a wind box (30) for after-air, and the primary after-air (1) and the secondary after-air (11) are supplied to the furnace (31) via a primary after-air nozzle (5) and secondary after-air nozzles (14), respectively. The primary after-air nozzle (5) includes a primary after-air nozzle inlet contracting member (5*a*) which is installed in the inlet thereof and has a cross-section gradually decreased toward the flow direction, to suppress the pressure loss in the inlet of the primary after-air nozzle. The primary after-air nozzle (5) includes primary after-air flow rate control dampers (3) which are installed in an inlet part thereof and are capable of changing the flow path resistance, to optimally control the flow rate of the primary after-air (1).

The primary after-air nozzle (5) includes a primary after-air rectifier (4) which is installed inside thereof and made of a plate material provided with a plurality of through holes. Even when the deviation of velocity distribution exists in the primary after-air (1) at the inlet part of the primary after-air nozzle (5), it is rectified to a uniform flow by the primary after-air rectifier (4), and thus the primary after-air (1) is supplied to the furnace (31) as a jet having stable penetration.

As illustrated in FIG. 10(*a*), in the present example, openings (17) and (18) of the after-air port are formed in a hexagonal shape. As seen above, by applying the hexagonal openings (throat parts) (17) and (18), the secondary after-air flow rate control dampers (12), the secondary after-air guide vanes (15), and the like may also be formed in simple hexagonal shape. Therefore, it may be effective in terms of production costs, while achieving the function of the present invention.

The structure of the furnace wall in which the after-air ports are installed may be various, such as a panel of a water cooling tube group, a structure of a fireproof wall and metal, or the like, but it may be appropriately selected depending on the structure of the after-air port having the rectangular or hexagonal opening, also in consideration of the production costs.

When the after-air ports described in the above respective examples are applied as after-air ports (7) (7*a* and 7*b*), depending on the flow rate distribution of the combustion gas containing the unburned components and rising from burners (6), it is possible to appropriately set the after-air flow rate distribution and jet direction of the primary after-air (1) and the secondary after-air (11), and stably maintain the penetration of the primary after-air (1) jet and the spreadability of the secondary after-air (11) jet, as well as, achieve high combustion performance by effectively reducing the unburned components.

When the after-air ports (7) (7*a* and 7*b*) of the above respective examples are applied as the combustion device having a single stage (one stage) after-air ports (7) (7*a* and 7*b*), as described above, it is possible to achieve high combustion performance. However, in the combustion device having multiple stages of after-air ports (7) (7*a* and 7*b*), even when the after-air ports (7) (7*a* and 7*b*) formed by the present invention are applied as all stages of after-air ports (7) (7*a* and 7*b*) or as a part of stages of after-air ports (7) (7*a* and 7*b*), it is possible to achieve high combustion performance by effectively reducing the unburned components.

In the combustion device having the single stage or multiple stages of after-air ports, the after-air ports formed by the present invention may be applied to the after-air ports (7*a*), and the conventional after-air ports of cited invention 3 may be applied to the sub after-air ports (7*b*).

Further, even when the after-air ports (7) are applied to a single surface combustion type combustion device in which the burners are disposed only on one side of the furnace front and rear walls, or a tangential combustion type combustion device in which the burners are disposed in entire surfaces or corner portions of the furnace front and rear walls, it is possible to achieve high combustion performance by effectively reducing the unburned components by utilizing the penetration and spreadability of the primary and secondary after-air jets.

In addition, FIGS. 4 and 6 define the function capable of controlling the direction of the secondary after-air jets, and flow rate of the primary after-air and the secondary after-air, but any one of manual and automatic control means may be used. When applying the automatic control means, it is possible to apply a control program that changes the settings based on an operation condition such as load, after-air total flow rate, and the like.

EXAMPLE 9

Figure 11:
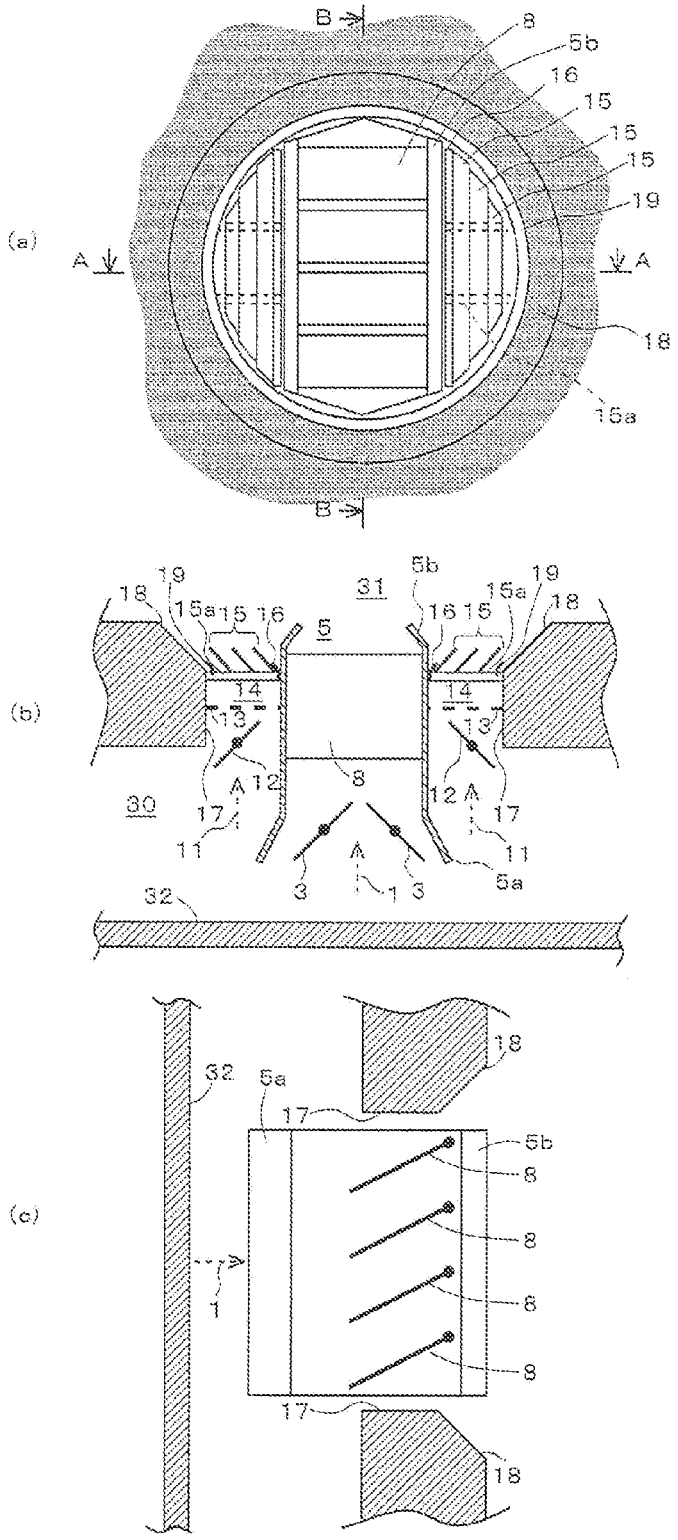
FIG. 11 is a front view of an after-air port according to another example of the present invention (FIG. 11(*a*)), a cross-sectional view taken in the arrow direction of line A-A in FIG. 11(*a*) (FIG. 11(*b*)), and a cross-sectional view taken in the arrow direction of line B-B in FIG. 11(*a*) (FIG. 11(*c*)).

FIG. 11 illustrates an after-air port according to a ninth example of the present invention. FIG. 11(*a*) is a front view as viewed from the furnace side, FIG. 11(*b*) is a cross-sectional view taken in the arrow direction of line A-A in FIG. 11(*a*), and FIG. 11(*c*) is a cross-sectional view taken in the arrow direction of line B-B in FIG. 11(*a*). In the present example, the primary after-air nozzle (5) is provided with primary after-air guide vanes (8) inside thereof. Multiple stages of the primary after-air guide vanes (8) are installed in a height direction of the after-air port along the flow of the after-air. Herein, rear ends of the primary after-air guide vanes (8) in the flow of the primary after-air (1) are at a fixed position, and front ends thereof in the flow of the primary after-air (1) are formed in a movable type. When the front ends of the primary after-air guide vanes (8) move downward from the horizontal direction, the primary after-air guide vanes (8) have an upwardly inclined angle, and it is possible to upwardly inject the primary after-air (1) into the furnace.

Figure 12:
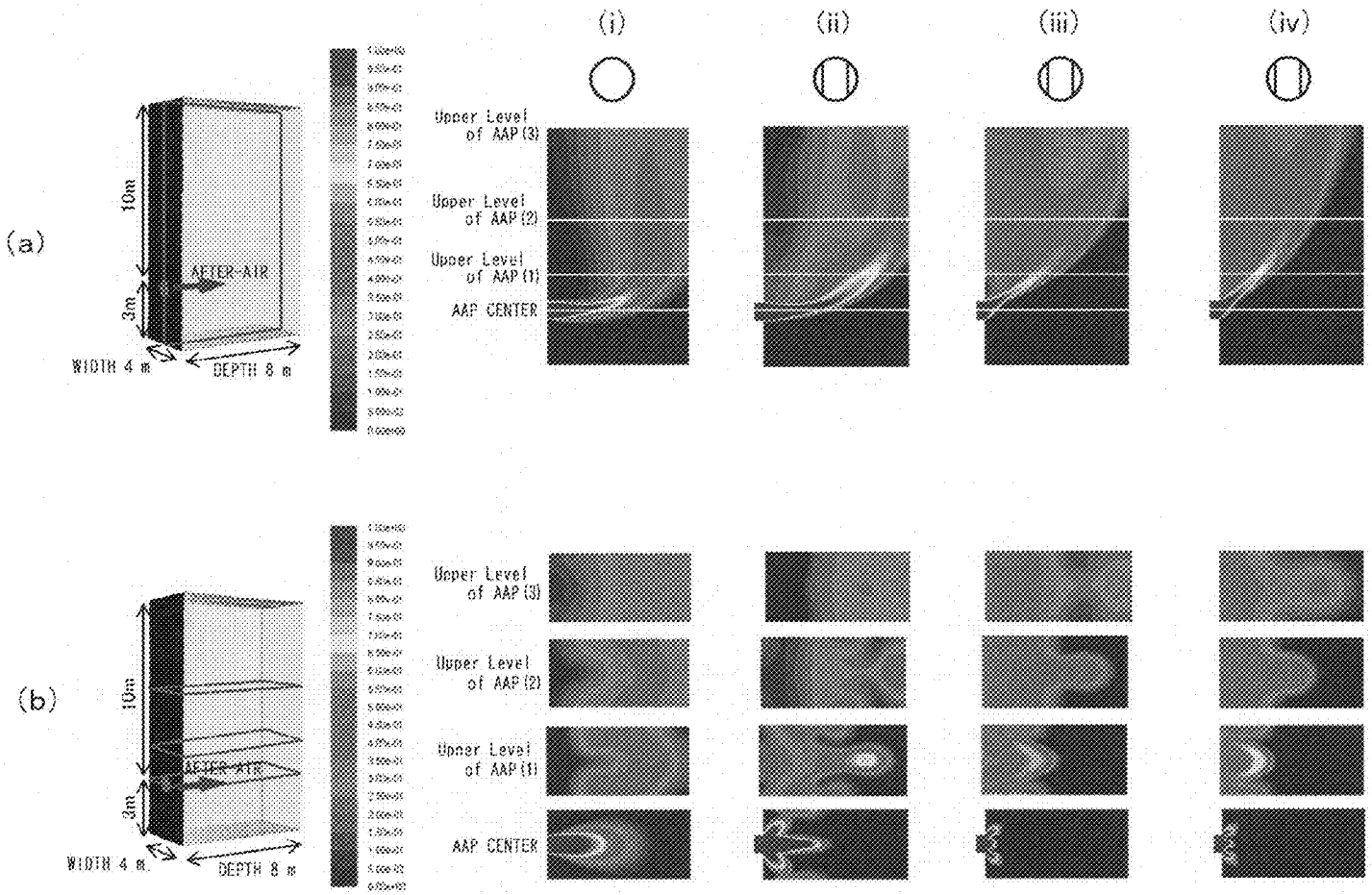
FIG. 12 is a view for describing a difference in a penetration force within the furnace due to a difference in the inclination angle of the primary after-air guide vanes in the after-air port of FIG. 1.
Figure 13:
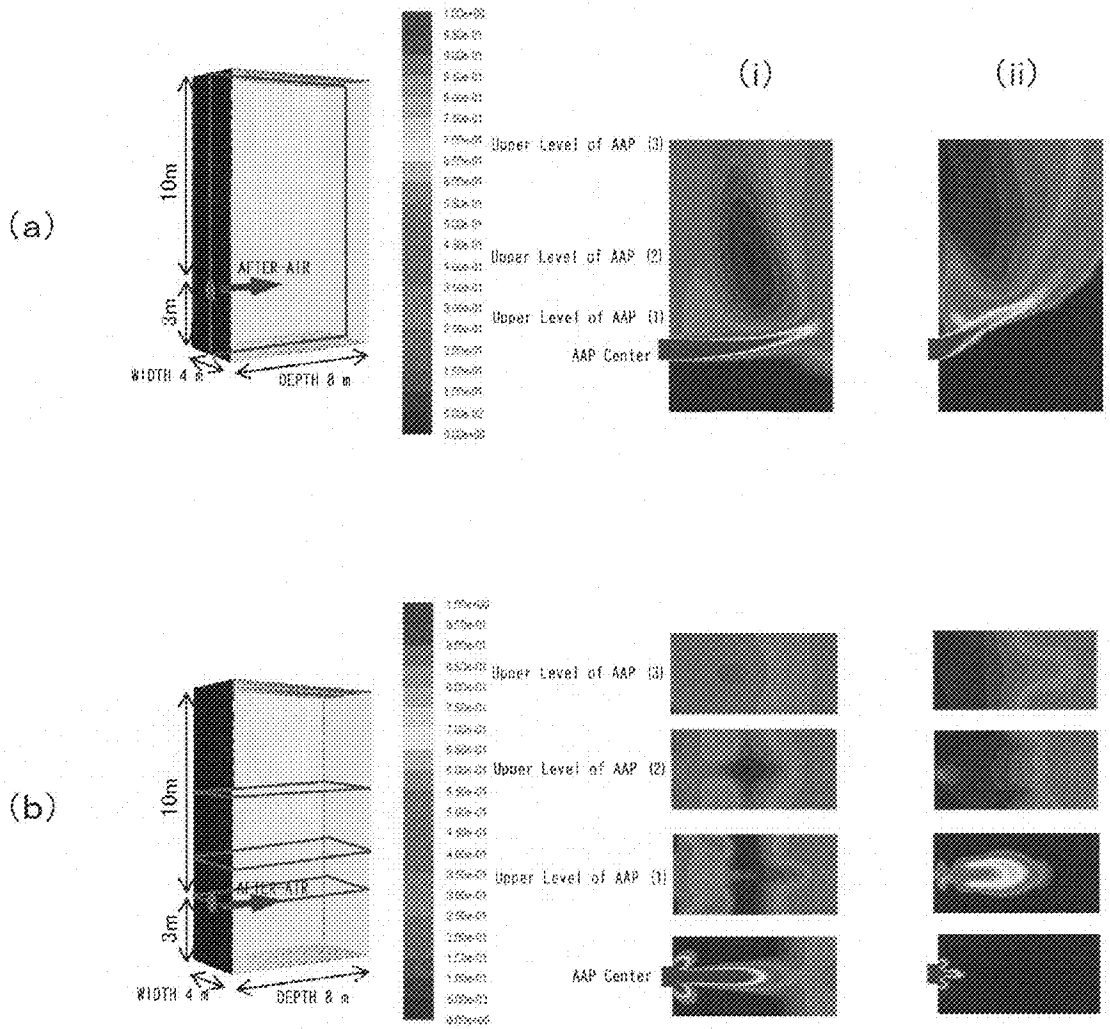
FIG. 13 is a view for describing the difference in the penetration force within the furnace when a flow rate ratio of a primary after-air to a secondary after-air is set to be 8:2 in the after-air port of FIG. 1.
Figure 14:
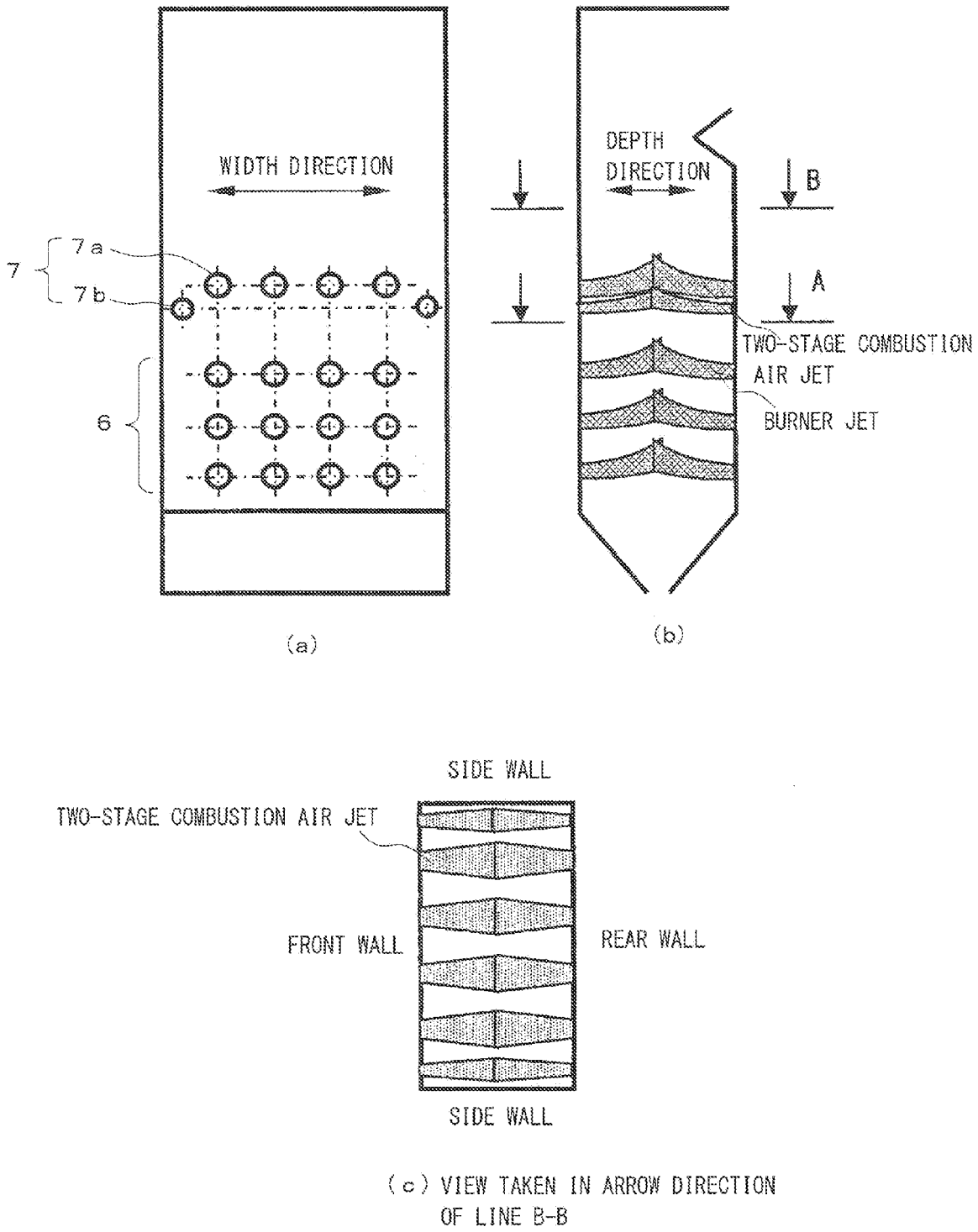
FIG. 14 includes a front view of a furnace wall in which burners and the after-air ports are disposed (FIG. 14(*a*)), a side sectional view thereof (FIG. 14(*b*)), and a plan sectional view thereof (FIG. 14(*c*)).

FIGS. 12 and 13 illustrate a shape of jet of the after-air structure according to the present example. Furthermore, the results illustrated in FIGS. 12 and 13 are the results of numerical analysis of the same system as a jet analysis of the after-air structure shown in FIG. 16. In addition, the analysis of FIG. 12 was performed by a flow rate ratio of 6:4 of the primary after-air (1) to the secondary after-air (11). As similar to FIG. 16, these drawings illustrate contrasting densities (actually expressed by a difference in color) obtained by representing the air concentration of the after-air in a strip shape and showing it in a dimensionless way as an after-air mass distribution. AAP center, Upper level of AAP (1), Upper level of AAP (2) and Upper level of AAP (3) shown in FIGS. 12 and 13 illustrate a height from the AAP center, respectively, which are sequentially increased from (1) to (3).

FIG. 12(*a*) shows the shape and the after-air concentration distribution of the jet due to a difference in the cross-sectional shape of the AAP opening in the plane of the vertical direction passing through the central axis $C_0$ of the after-air port (AAP) (7) (see FIG. 2) by the contrasting densities (actually expressed by a difference in color), and FIG. 12(*b*) shows the shape and the after-air concentration distribution of the jet due to a difference in the cross-sectional shape of the AAP opening in the plane of the horizontal direction passing through the central axis $C_0$ of the after-air port (AAP) (7) by the contrasting densities (actually expressed by a difference in color).

(i) of FIGS. 12(*a*) and (*b*) illustrates a case of without the primary after-air guide vane (8), (ii) of FIGS. 12(*a*) and (*b*) illustrates a case that the inclination angle with respect to the horizontal of the primary after-air guide vanes (8) is 0°, (iii) of FIGS. 12(*a*) and (*b*) illustrates a case that the inclination angle with respect to the horizontal of the primary after-air guide vanes (8) is upward 25° on the furnace outlet side (hereinafter, briefly referred to as upward), and (iv) of FIGS. 12(*a*) and (*b*) illustrates a case that the inclination angle with respect to the horizontal of the primary after-air guide vanes (8) is upward 45°.

In the result when the plane of the primary after-air guide vanes (8) faces the horizontal direction ((ii) of FIG. 12 (*a*)), the jet of the primary after-air (1) has a high penetration force, and collides with the primary after-air jet from the opposite wall at the central part of the furnace. This is effective for reducing the unburned components by facilitating the combustion, when using a flame retardant fuel with a low combustion rate, in order to facilitate the mixing in the central part of the furnace.

In addition, it can be seen that the secondary after-air (11) spreads at the outlet of the AAP (7), and is separated from the primary after-air (1) to spread in the horizontal direction.

In the result when the inclination angle of the primary after-air guide vanes (8) is set to be an upward angle of 25° ((iii) of FIG. 12 (*b*)), the primary after-air (1) is injected upward, rather than horizontal. However, since the primary after-air has a substantial penetration force without being affected by the combustion gas in the furnace, it is possible to confirm that it collides with the after-air from the opposite wall at the center of the furnace.

From the above results, there is an effect to facilitate the mixing of the after-air (1) and (11), such that in the case of fuel with relatively excellent combustibility, the combustion is facilitated, and it is effective for reducing the unburned components. In addition, since the mixing of the after-air (1) and (11) shifts to the top of the furnace, and the mixing of the combustion gas rising in the furnace with the after-air (1) and (11) is delayed, there are advantages that the residence time of the combustion gas is increased, and NOx reduction is strengthened. It can be seen that the secondary after-air (11) is separated from the primary after-air (1), spreads in the horizontal direction, and spreads along the wall surface in which the AAP is installed. From this, it can be seen that it is effective for reducing the unburned components in the region illustrated by the one dot dash line C in FIG. 3(*b*).

(iv) of FIGS. 12(*a*) and (*b*) illustrates the result when the inclination angle of the primary after-air guide vanes (8) is set to be an upward angle of 45°. In these cases, the primary after-air has a substantial upward penetration force, but reaches the top of the furnace before reaching the central part of the furnace, and it was not observed that it collides with the after-air from the opposite wall. From this, it is preferable that the inclination angle of the primary after-air guide vanes (8) ranges from 0 to 25°.

FIG. 13 is a view illustrating the distribution of the jet when the flow rate ratio of the primary after-air (1) to the secondary after-air (11) is set to be 8:2, in the after-air structure of the present invention. FIG. 13(*a*) shows the shape and the after-air concentration distribution of the jet in the plane of the vertical direction passing through the central axis $C_0$ of the after-air port (AAP), and FIG. 13(*b*) shows the shape and the after-air concentration distribution of the jet in the plane of the horizontal direction passing through the central axis $C_0$ of the after-air port (AAP).

FIGS. 13(*a*) and (*b*) illustrate the shape and the temperature distribution of the jet as the contrasting densities (actually expressed by a difference in color), wherein (i) shows a case of setting the inclination angle of the primary after-air guide vanes (8) to be 0°, and (ii) shows a case of setting the inclination angle of the primary after-air guide vanes (8) to be 25°, respectively.

It can be seen from FIG. 13 that, by increasing the flow rate of the primary after-air (1), the jet of the primary after-air (1) has an increased penetration force, while the flow rate of the secondary after-air (11) is decreased, and spreads in the horizontal direction at the outlet of AAP (7). When the primary after-air guide vanes (8) are horizontally installed, the secondary after-air (11) spreads in the horizontal direction, and spreads along the wall surface in which the AAP (7) is installed. As a result, compared to FIG. 12(*a*) having a high flow rate of the secondary after-air (11), the diffusion in the vicinity of the wall surface is promoted, and reducing the unburned components is facilitated in the region of C in FIG. 15(*b*).

REFERENCE SIGNS LIST

1 primary after-air
3 primary after-air flow rate control damper
4 primary after-air rectifier
5 primary after-air nozzle
5*a* primary after-air nozzle inlet contracting member
5*b* primary after-air nozzle outlet contracting member
6 burner
7*a* after-air port
7*b* sub after-air port
8 primary after-air guide vane
11 secondary after-air
11*a* circulation vortex
12 secondary after-air flow rate control damper
13 secondary after-air rectifier
14 secondary after-air nozzle
15 secondary after-air guide vane
15*a* fixing member
16 first guide member
17 after-air port opening (throat part)
18 after-air port opening spreading part
19 second guide member
20 secondary after-air guide vane operation lever
21 secondary after-air guide vane operation lever through part seal
22 secondary after-air guide vane rotation shaft
23 secondary after-air guide vane link
24 secondary after-air guide vane link rotation shaft
25 air separation plate
30 wind box for after-air
31 furnace
32 wind box casing for after-air
S sealing air

The invention claimed is:

1. A combustion device in which burners are disposed on a furnace wall to burn fuel with an amount of air of theoretical air or less, and after-air ports to supply air are disposed on the furnace wall in the downstream side from the position where the burners are disposed, the combustion device characterized in that it comprises:

a primary after-air nozzle (5) which is provided at the central part in an opening (17) of the after-air port with larger vertical height than horizontal width to supply a primary after-air (1);

secondary after-air nozzles (14) which are provided in the opening (17) of the after-air port at the outside of the primary after-air nozzle (5) to supply a secondary after-air (11); and one or more pairs of secondary after-air guide vanes (15) which are provided in the outlet parts of the secondary after-air nozzles (14) and have inclination angles with respect to a central axis of the after-air port, so as to deflect the secondary after-air (11) right and left in the horizontal direction and supply the same.

2. The combustion device according to claim 1, characterized in that the primary after-air nozzle (5) includes one or more primary after-air guide vanes (8) which are provided in the outlet part thereof and are configured to control an inclination angle thereof in the horizontal direction or upward from the horizontal direction, so as to supply the primary after-air (1) upward with an inclination angle.

3. The combustion device according to claim 1, characterized in that the secondary after-air guide vanes (15) all have the same inclination angles with respect to the central axis of the after-air port.

4. The combustion device according to claim 1, characterized in that each of the secondary after-air guide vanes (15) has a deviation in the inclination angles thereof with respect to the central axis of the after-air port.

5. The combustion device according to claim 4, characterized in that the secondary after-air guide vanes (15) have inclination angles becoming larger with increasing distance away from the primary after-air nozzle (5) with respect to the central axis of the after-air port.

6. The combustion device according to claim 1, characterized in that the secondary after-air guide vanes (15) are configured to change the inclination angles thereof.

7. The combustion device according claim 1, characterized in that the secondary after-air guide vanes (15) are configured to move in the anteroposterior direction of the furnace wall.

8. The combustion device according to claim 1, characterized in that a first guide member (16) is provided at a portion nearest the primary after-air nozzle (5), to supply a small amount of secondary after-air (11) along a surface of the secondary after-air guide vane (15) on the furnace side thereof and the outer surface of the tip part of the primary after-air nozzle (5).

9. The combustion device according to claim 1, characterized in that the openings (17) of the after-air port have spreading parts (18) of a shape whose end spreads toward the furnace, and are respectively provided with second guide members (19) to supply a small amount of the secondary after-air (11) along surfaces of the spreading parts (18).

10. The combustion device according to claim 1, characterized in that any one or both of an inlet part of the primary after-air nozzle (5) and inlet parts of the secondary after-air nozzles (14) are provided with air flow rate control functional members to change a flow path resistance.

11. The combustion device according to claim 1, characterized in that the primary after-air nozzle (5) includes a contracting member (5*a*) having a flow passage cross-sectional area gradually decreased in a flow direction of air, which is attached to the inlet part thereof.

12. The combustion device according to claim 1, characterized in that the primary after-air nozzle (5) includes a contracting member (5*b*) having a horizontal width gradually decreased in a flow direction of air, which is attached to the tip part thereof.

13. The combustion device according to claim 1, characterized in that any one or both of the primary after-air nozzle (5) and the secondary after-air nozzles (14) include rectifiers installed in flow passages thereof.

14. The combustion device according to claim 1, characterized in that the opening (17) of the after-air port is formed in a rectangular shape.

15. The combustion device according to claim 1, characterized in that the opening (17) of the after-air port is formed in a polygonal shape.

* * * * *